US012702226B2

(12) United States Patent
Behrmann et al.

(10) Patent No.: US 12,702,226 B2
(45) Date of Patent: Aug. 11, 2026

(54) GUIDE FITTING AND FURNITURE OR HOUSEHOLD APPLIANCE ELEMENT

(71) Applicant: PAUL HETTICH GMBH & CO. KG, Kirchlengern (DE)

(72) Inventors: Gunter Behrmann, Kirchlengern (DE); Kathrin Heckel, Bissendorf (DE); Timo Szlapka, Bielefeld (DE); Waldemar Petker, Bünde (DE); Bernd Götting, Enger (DE); Sören Klüter, Bad Oeynhausen (DE)

(73) Assignee: Paul Hettich GmbH & Co. KG, Kirchlengern (DE)

( * ) Notice: Subject to any disclaimer, the term of this patent is extended or adjusted under 35 U.S.C. 154(b) by 110 days.

(21) Appl. No.: 18/860,235

(22) PCT Filed: Apr. 21, 2023

(86) PCT No.: PCT/EP2023/060496
§ 371 (c)(1),
(2) Date: Oct. 25, 2024

(87) PCT Pub. No.: WO2023/208778
PCT Pub. Date: Nov. 2, 2023

(65) Prior Publication Data

US 2025/0288099 A1 Sep. 18, 2025

(30) Foreign Application Priority Data

Apr. 27, 2022 (DE) ..... 10 2022 110 204.1

(51) Int. Cl.
*A47B 49/00* (2006.01)

(52) U.S. Cl.
CPC ..... *A47B 49/004* (2013.01)

(58) Field of Classification Search
CPC ..... A47B 49/00; A47B 49/004; A47B 49/006; A47B 49/008; A47B 96/025; A47B 81/002; A47B 77/10
See application file for complete search history.

(56) References Cited

U.S. PATENT DOCUMENTS 4,124,262 A * 11/1978 Schill ..... A47B 49/004 312/307
5,249,856 A * 10/1993 Dreier ..... A47B 49/006 211/163

(Continued)

FOREIGN PATENT DOCUMENTS

DE 202009007374 U1 9/2009
DE 102011053840 A1 3/2013

(Continued)

OTHER PUBLICATIONS

International Search Report and Written Opinion mailed Jul. 25, 2023 in related/corresponding International Application No. PCT/EP2023/060496.

(Continued)

*Primary Examiner* — Patrick D Hawn
(74) *Attorney, Agent, or Firm* — PATENT PORTFOLIO BUILDERS PLLC

(57) ABSTRACT

A guide fitting, guiding a body part for simultaneous translational and rotational movement relative to a stationary base, has a guide cam track, a guide element guided in the at least one guide cam track, and a linear guide with at least one guide rail and a running rail displaceable relative thereto, one of which is coupled in a stationary manner to the guide element and the other of which is coupled to the guide cam track by a pivot bearing. The guide cam track or the guide element can be fixedly fastened to the body part. The fitting also includes at least one ejection device with an unlockable force accumulator drives the body part from at (Continued)

Figure 1:
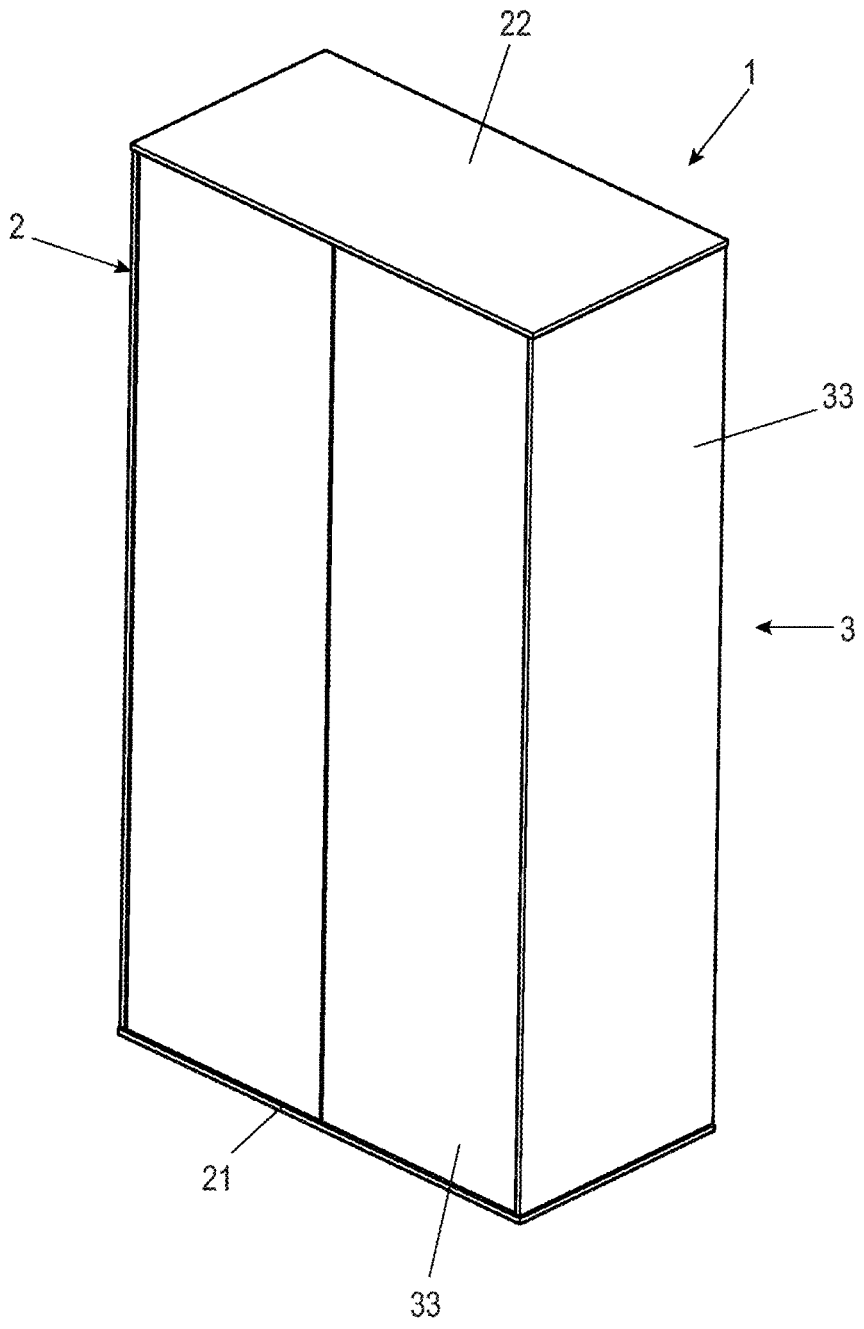

least one end position by exerting force against an ejection direction along a limited path, and at least one activator for unlocking the force accumulator of the ejection device.

15 Claims, 21 Drawing Sheets

(56) References Cited

U.S. PATENT DOCUMENTS

| | | | | |
|---|---|---|---|---|
| 8,020,951 | B2 * | 9/2011 | Twellmann | A47B 81/002 312/238 |
| 11,098,758 | B2 | 8/2021 | Rehage et al. | |
| 11,209,208 | B2 * | 12/2021 | Rehage | F25D 25/027 |
| 11,350,745 | B2 * | 6/2022 | Rehage | A47B 91/06 |
| 11,839,297 | B2 | 12/2023 | Rehage et al. | |
| 11,937,693 | B2 | 3/2024 | Rehage et al. | |
| 12,075,911 | B2 * | 9/2024 | Rehage | A47B 96/025 |
| 12,357,088 | B2 * | 7/2025 | Boekhoff | A47B 49/004 |
| 2018/0049545 | A1 * | 2/2018 | Sagel | A47B 81/002 |
| 2019/0167000 | A1 * | 6/2019 | Storck | A47B 88/48 |
| 2022/0211206 | A1 * | 7/2022 | Rehage | A47B 91/005 |
| 2024/0423361 | A1 * | 12/2024 | Nordieker | A47B 49/004 |
| 2025/0169605 | A1 * | 5/2025 | Bauerrichter | A47B 49/00 |
| 2025/0185804 | A1 * | 6/2025 | Koptik | A47B 81/002 |

FOREIGN PATENT DOCUMENTS

| | | | | | |
|---|---|---|---|---|---|
| DE | 102017106170 | A1 | | 9/2018 | |
| DE | 102019109866 | A1 | | 10/2020 | |
| DE | 102019113251 | A1 | | 11/2020 | |
| DE | 102019132207 | A1 | | 5/2021 | |
| DE | 102019132208 | A1 | | 5/2021 | |
| DE | 102021110322 | A1 | * | 7/2022 | A47B 49/006 |
| DE | 102021128965 | A1 | | 5/2023 | |
| DE | 102022134222 | A1 | | 6/2024 | |
| DE | 202022003154 | U1 | * | 2/2025 | A47B 49/00 |
| DE | 202022003155 | U1 | * | 2/2025 | A47B 49/00 |
| DE | 202022003158 | U1 | * | 2/2025 | A47B 49/006 |
| DE | 202022003159 | U1 | * | 2/2025 | A47B 46/00 |
| DE | 202022003160 | U1 | * | 2/2025 | A47B 46/00 |
| DE | 202022003162 | U1 | * | 2/2025 | A47B 49/00 |
| DE | 202022003163 | U1 | * | 2/2025 | A47B 49/00 |
| WO | WO-2020233911 | A1 | * | 11/2020 | A47B 49/006 |

OTHER PUBLICATIONS

Search Report created Nov. 15, 2022 in related/corresponding DE Application No. 10 2022 110 204.1.

* cited by examiner

GUIDE FITTING AND FURNITURE OR HOUSEHOLD APPLIANCE ELEMENT

BACKGROUND AND SUMMARY OF THE INVENTION

Exemplary embodiments of the present invention relate to a guide fitting for guiding a body part mounted for simultaneous translational and rotational movement, as well as to a furniture or household appliance element.

Such furniture or household appliance elements, such as shelves or racks, in which a body part mounted in a support body so that it can rotate and move in translation at the same time, are known, for example, from DE 10 2019 109 866 A1.

A translational-rotational bearing is used to perform the translational-rotational movement of the body part.

Particularly in the case of larger and/or taller furniture or household appliance elements, such as refrigerators and freezers or wine coolers, it is necessary to provide additional support for the movement of the translational-rotationally movable body part for reasons of stability.

For this purpose, it is known from DE 10 2019 132 207 A1, for example, to arrange a guide bearing between the cover plates of the support body and the body part, with which the translational-rotational movement is additionally guided.

Such a furniture or household appliance element has proven itself in practice.

To actuate such a translational-rotational movement, it may be necessary in some situations to pull the body part to be moved forward from a first end position.

For example, a handle can be fitted for this purpose. However, such a handle can, under certain circumstances, restrict the movement options of the body part relative to the support body, as such a handle would, for example, prevent the body part from rotating 180° relative to the support body in order to reach a desired position with the same surface area as the starting position before reaching the 180° rotated position on the support body by bumping against the support body.

Exemplary embodiments of the present invention are directed to a guide fitting and a furniture or household appliance element with which the triggering of a combined translational-rotational movement is facilitated.

The guide fitting according to the invention has a guide cam track, a guide element guided in the at least one guide cam track and a linear guide with at least a first connecting part and a second connecting part movable relative thereto, one of which is coupled in a stationary manner to the guide element and the other of which is coupled to the guide cam track by means of a pivot bearing.

The guide cam track or the guide element can be fixed to the body part.

The guide fitting is characterized by at least one ejection device with an unlockable force accumulator, with which the body part can be driven from at least one end position by exerting force against an ejection direction along a limited distance.

The guide fitting also has at least one activator for unlocking the force accumulator of the ejection device.

A guide fitting designed in this way makes it easy to trigger a combined translational-rotational movement of the body part relative to a fixed base.

According to an advantageous embodiment, the at least one ejection device is arranged in a fixed position relative to the guide element.

In a preferred embodiment, two activators are arranged on or at a fixed distance from the guide cam track.

The arrangement of such activators on the guide cam track makes it easy to trigger the translational-rotational movement via the rotational movement of the body part by pushing the body part against the desired rotational movement.

According to a preferred further development, the guide cam track has a guide groove accommodating the guide element and an arm extending outside the guide groove, on which at least one activator is arranged, in particular integrally formed.

According to one embodiment, two activators are arranged on the arm, in particular molded on.

By molding the activators to the guide cam track, the assembly effort of such a guide fitting is further advantageously reduced.

According to a further advantageous embodiment, the guide fitting also has a support plate to which the at least one first connecting part of the linear guide, the guide element, and the at least one ejection device are fixed.

The design of the guide fitting with such a support plate also simplifies the assembly and installation of the guide fitting.

In an advantageous further development, the support plate has a central region, on which two first connecting parts of the linear guides, which are aligned parallel to one another, are fastened, and two mirror-symmetrically shaped edge regions, with an ejection device being fixed to at least one of the edge regions. Preferably, an ejection device is fixed to each of the two edge regions.

This makes it possible to trigger the translational-rotational movement from two different end positions.

According to a further alternative embodiment, the at least one activator is arranged in a fixed position on the second connection part of the linear guide and the ejection device is arranged in a fixed position on or near the first connection part of the linear guide.

The arrangement of the activator on the linear guide also makes it easy to trigger the translational-rotational movement by activating the ejection device via the translational movement of the body part.

In all embodiments, the ejector device utilizes the relative movement between stationary furniture and furniture that initially moves approximately translationally. Approximately translatory here means that the translatory movement component of the furniture is significantly greater than the rotatory movement component at the start of the movement from an end position.

According to a further advantageous embodiment, the guide fitting has at least one further guide cam track in which a further guide element is guided, which additionally supports the guidance of the furniture.

The furniture or household appliance element according to the invention has a support body with a base support plate, a top support plate and at least one side wall, a body part which is mounted so as to be simultaneously movable in translation and rotation relative to the support body and has a base plate, a top plate and at least one side wall.

A guide fitting is arranged between the top support plate and the top plate and/or between the base support plate and the base plate.

The guide fitting has at least one guide cam track and a guide element guided in or on the guide cam track, which are arranged on respective facing surfaces of the top support plate and the top plate or the base support plate and the base plate.

The guide fitting also has a linear guide with connecting parts that can be displaced relative to one another in a direction of translation, one of which is arranged on the top support plate or the top plate and the other of which is mounted on the other of the top support plate or the top plate by means of a pivot bearing.

The linear guide preferably consists of two guide rails aligned parallel to each other and running rails that can be moved relative to these.

The guide fitting has at least one ejection device with an unlockable force accumulator and at least one activator for unlocking the force accumulator of the ejection device, with which the body part can be driven from at least one end position by exerting force against an ejection direction along a limited distance.

According to a further embodiment, the at least one ejection device is designed as an at least partially electric ejection device, with an electric motor for tensioning an ejector and/or for driving the ejection movement itself and/or with a sensor system for detecting a desired opening of the body part.

In an advantageous embodiment, the guide cam track is fixed to the base plate or the top plate of the body part and the guide element is fixed to the base support plate or the top support plate of the support body.

In a further advantageous embodiment, a first guide fitting is arranged between the base support plate and the base plate and a second guide fitting is arranged between the top support plate and the top plate.

An arrangement of two guide fittings is particularly suitable for furniture or household appliance elements with a larger height.

In a further advantageous embodiment, the body part can be moved relative to the support body from a first functional position into a second functional position rotated by a predetermined angle relative to the starting position, wherein in both functional positions the base plates and the top plates of the body part and the support body are aligned in matching geometries relative to one another.

BRIEF DESCRIPTION OF THE DRAWING FIGURES

Figure 2:
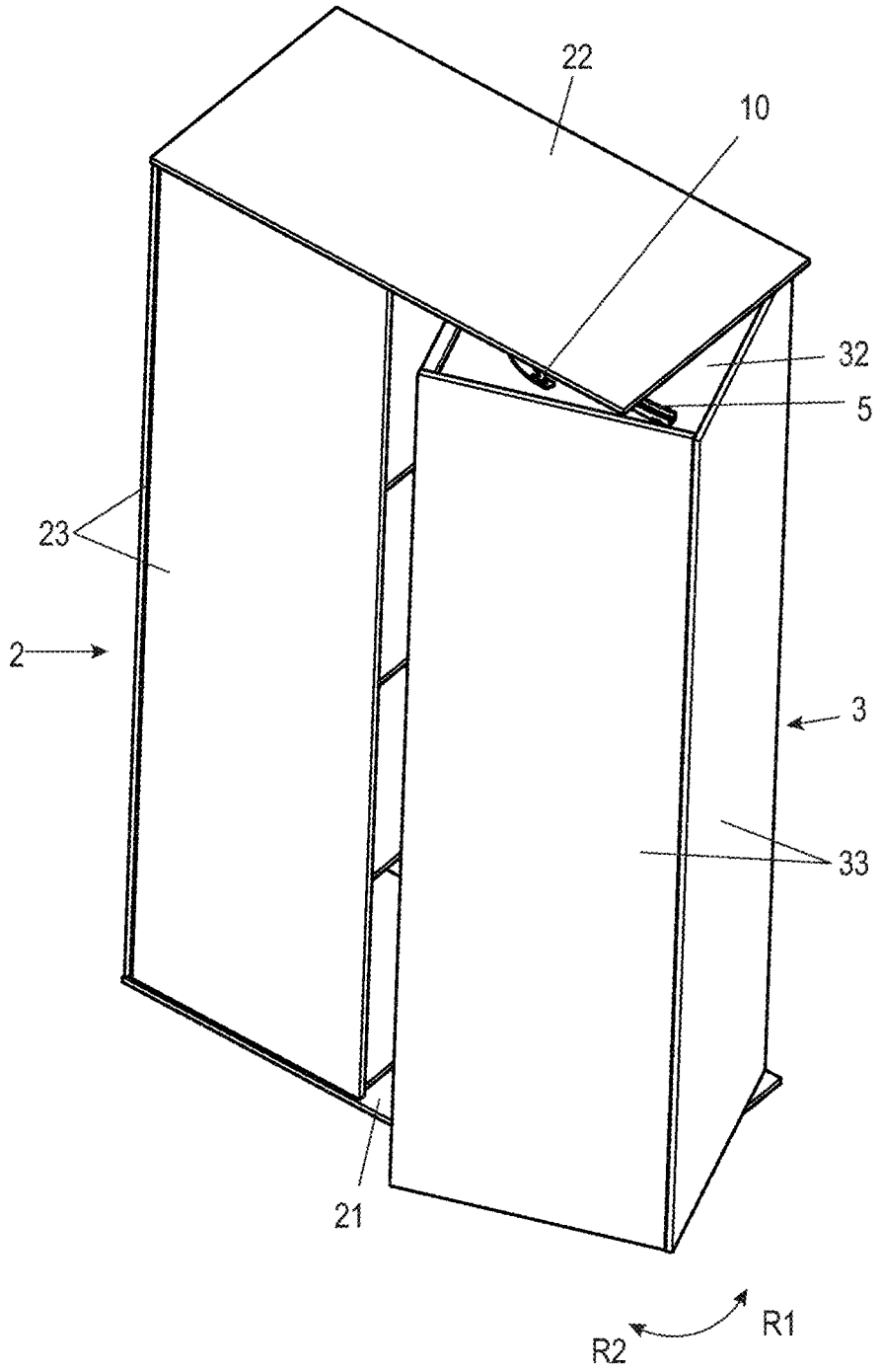
Figure 3:
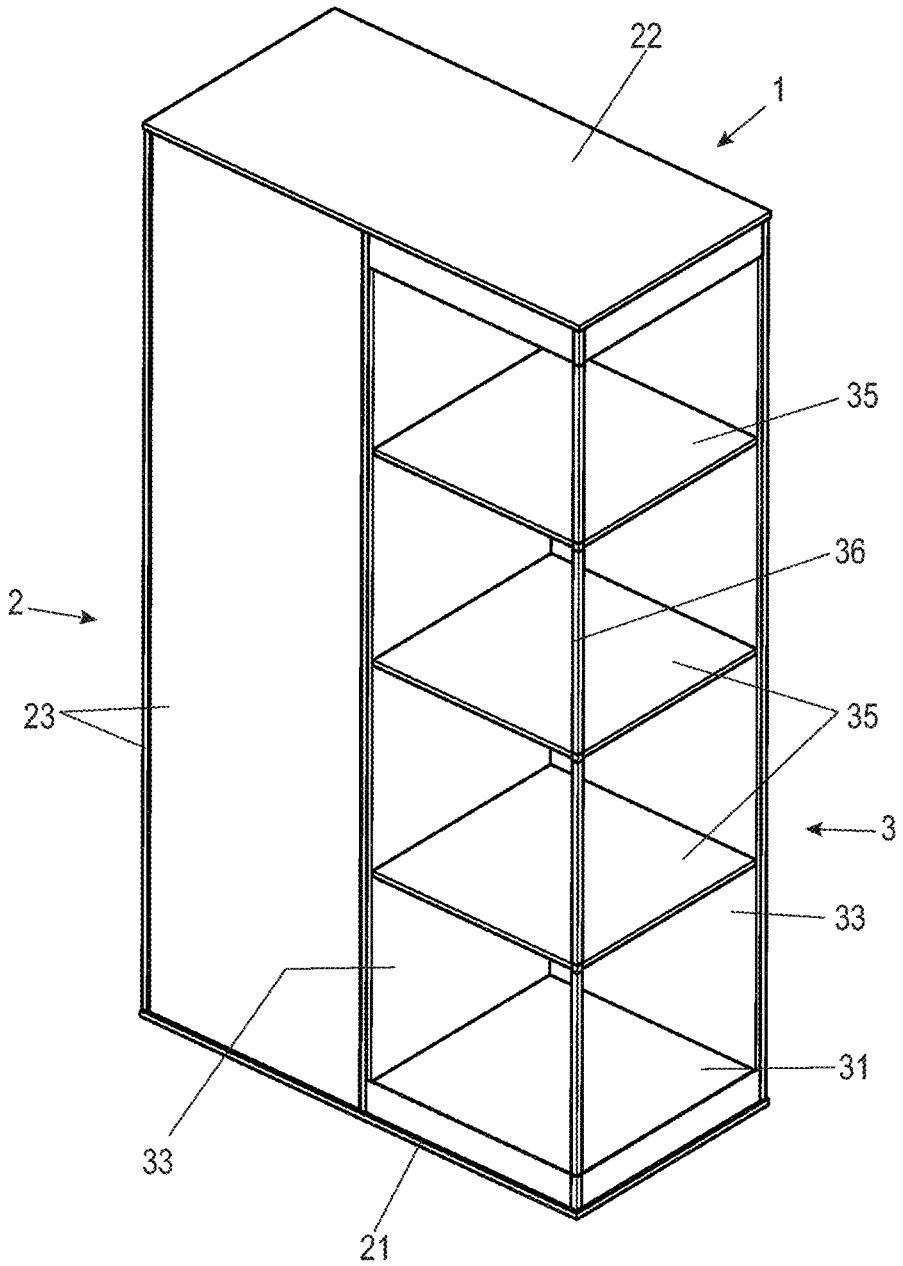
Figure 4:
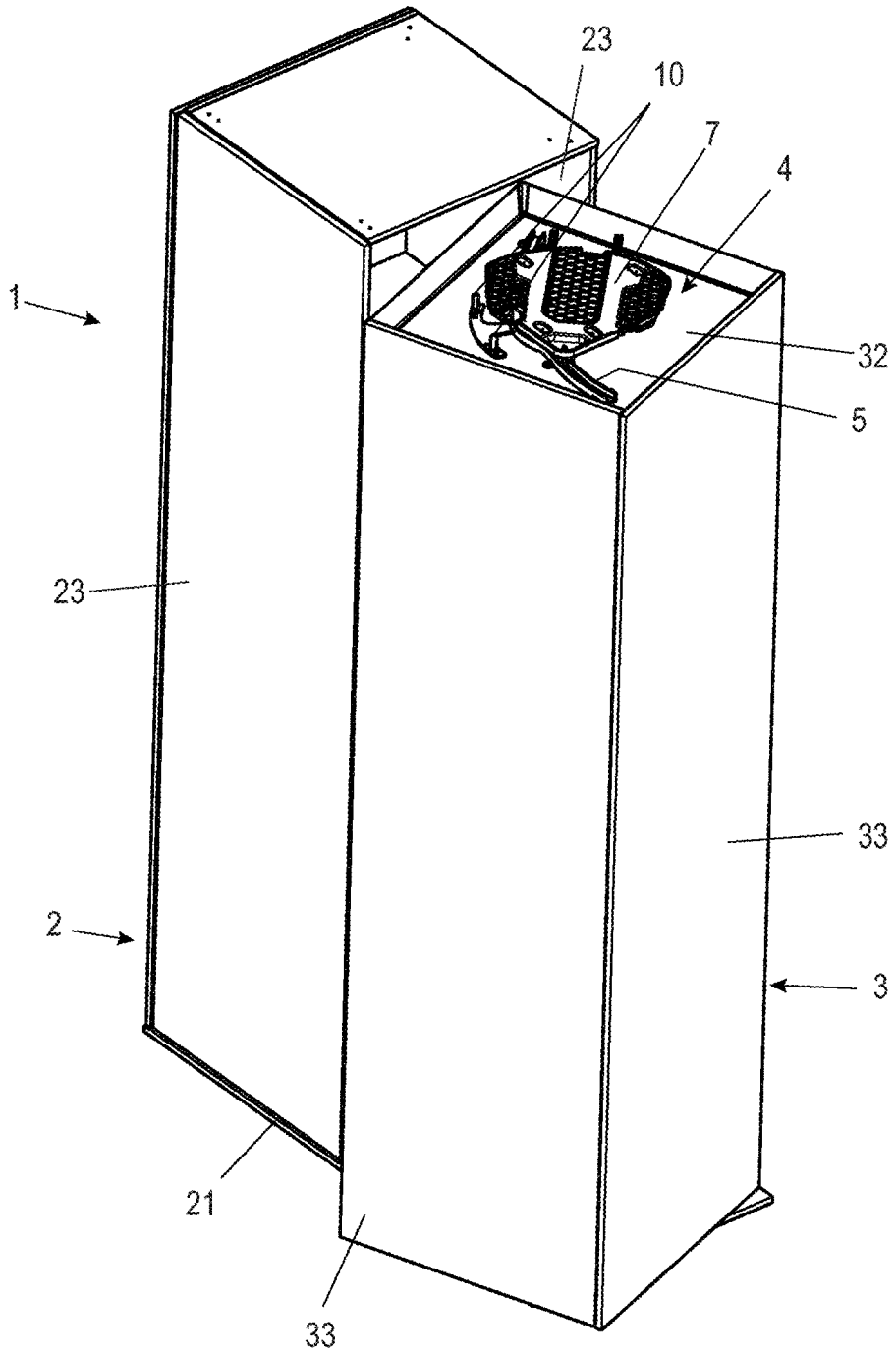
Figure 5:
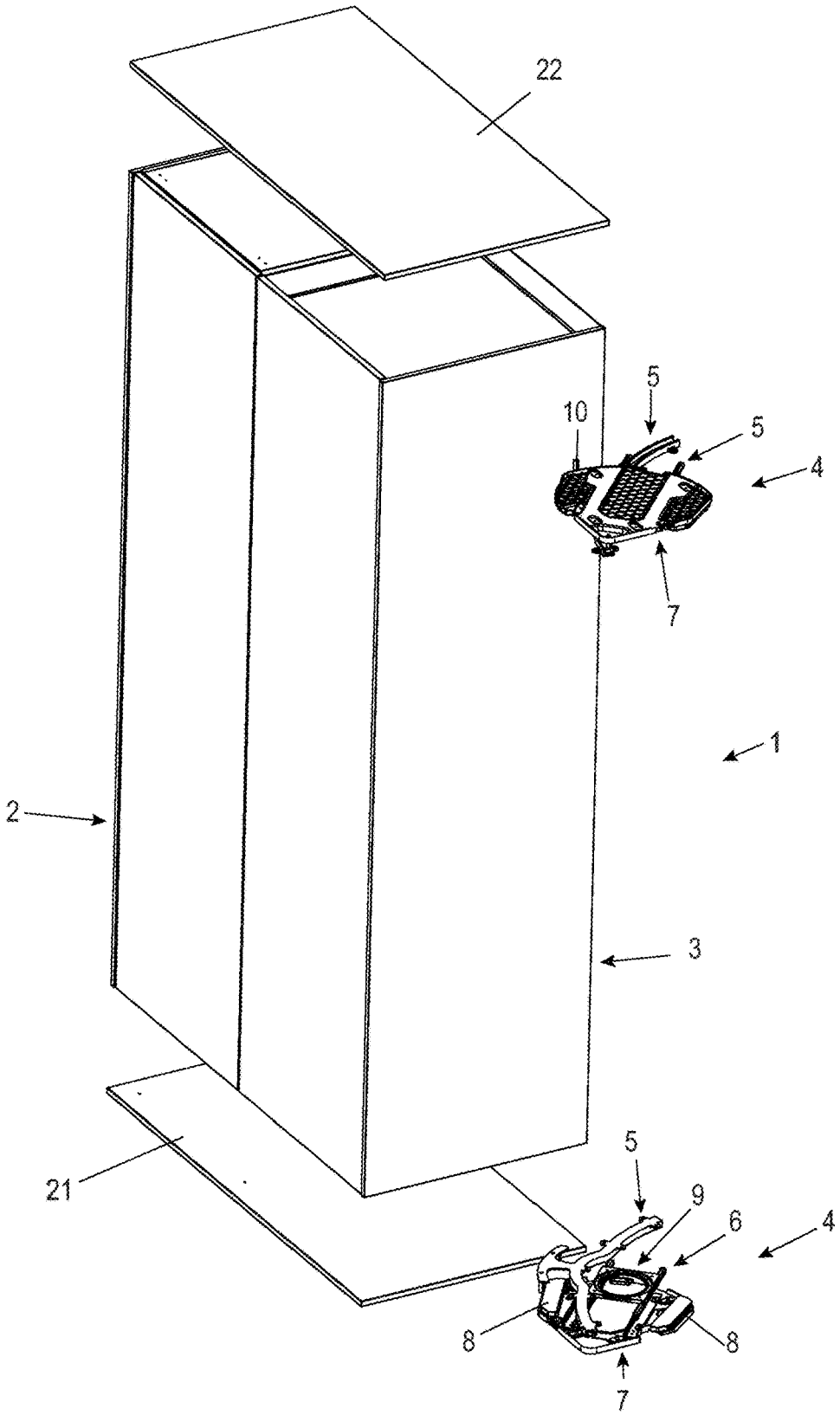
Figure 6:
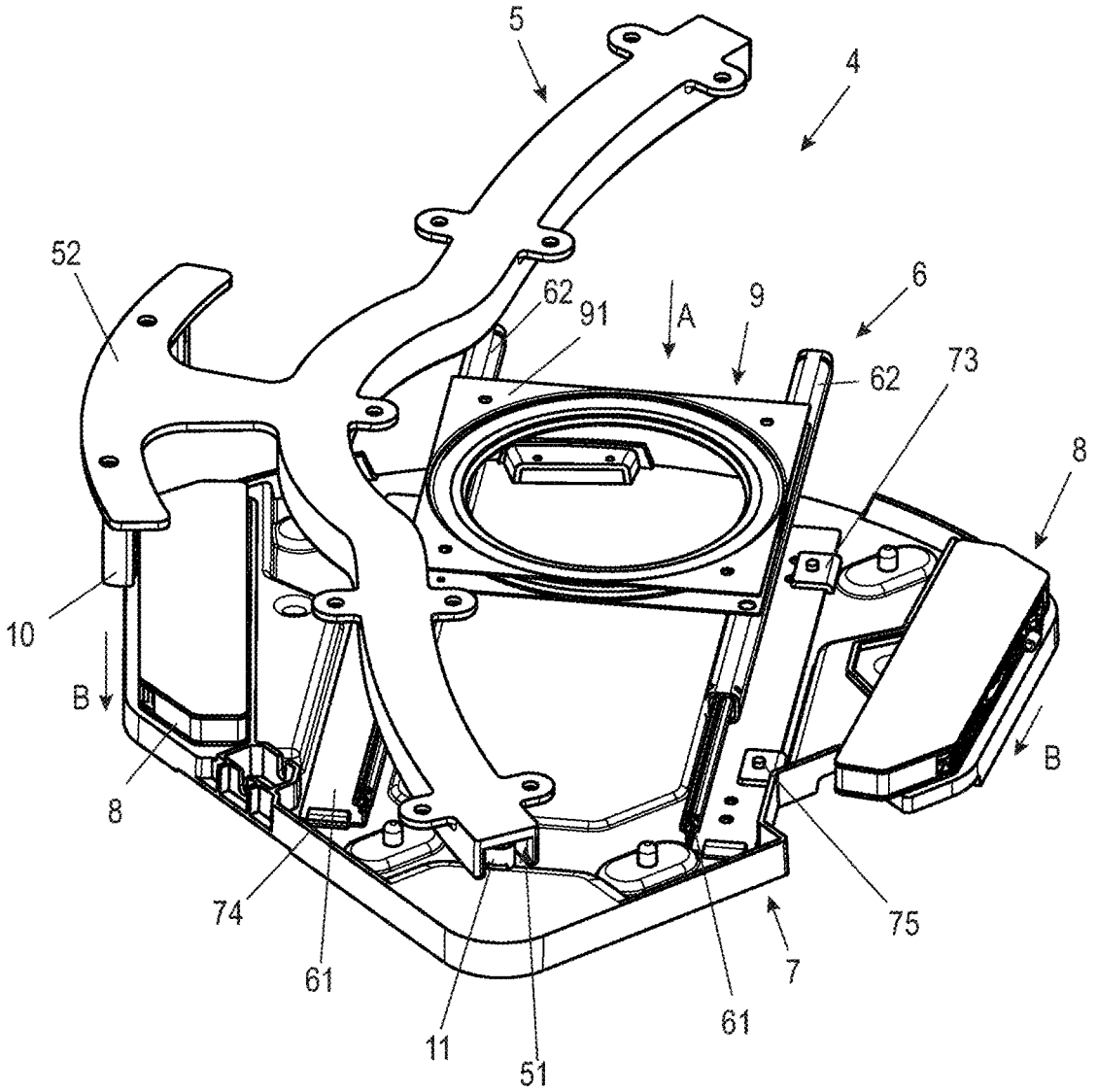
Figure 7:
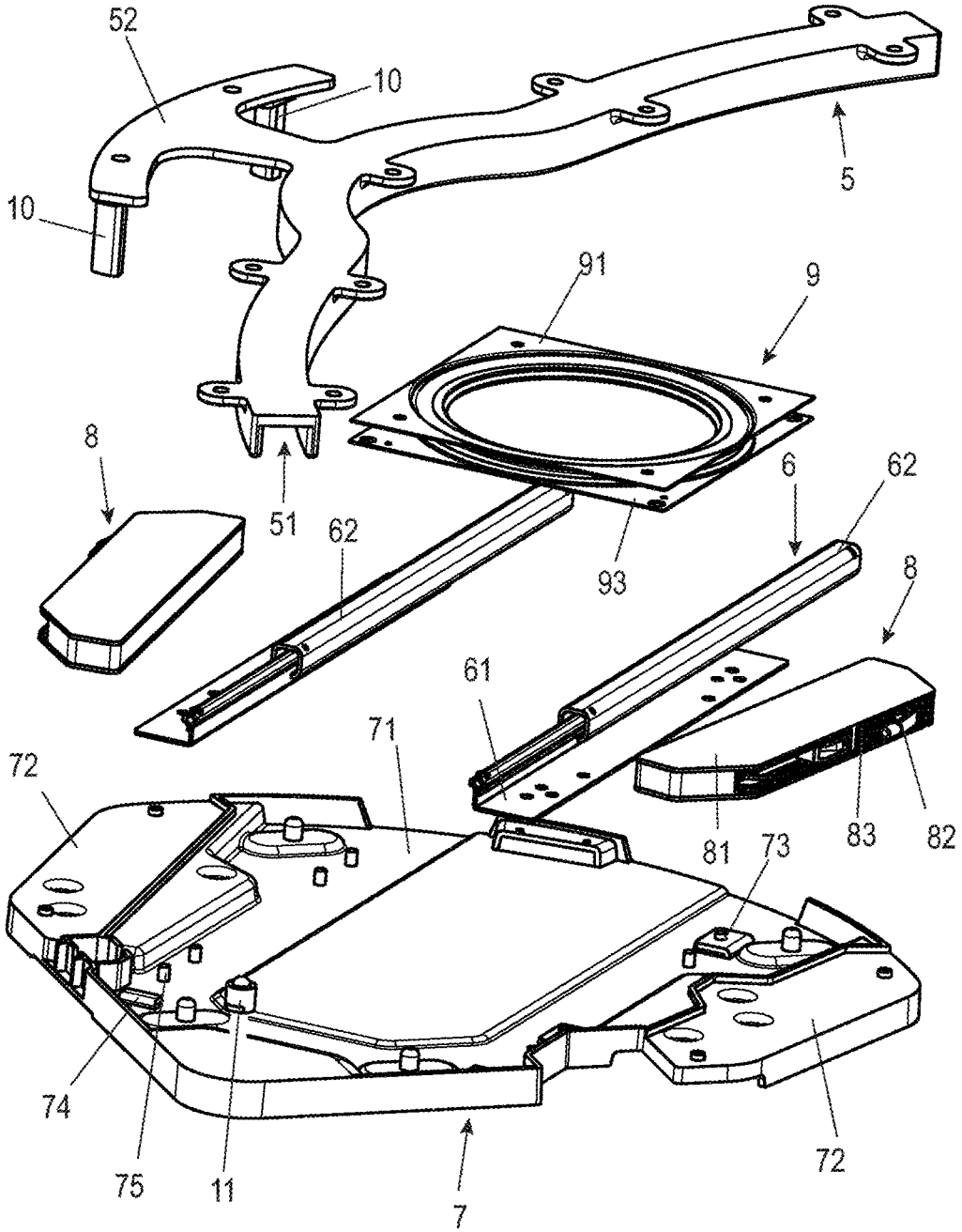
Figure 8:
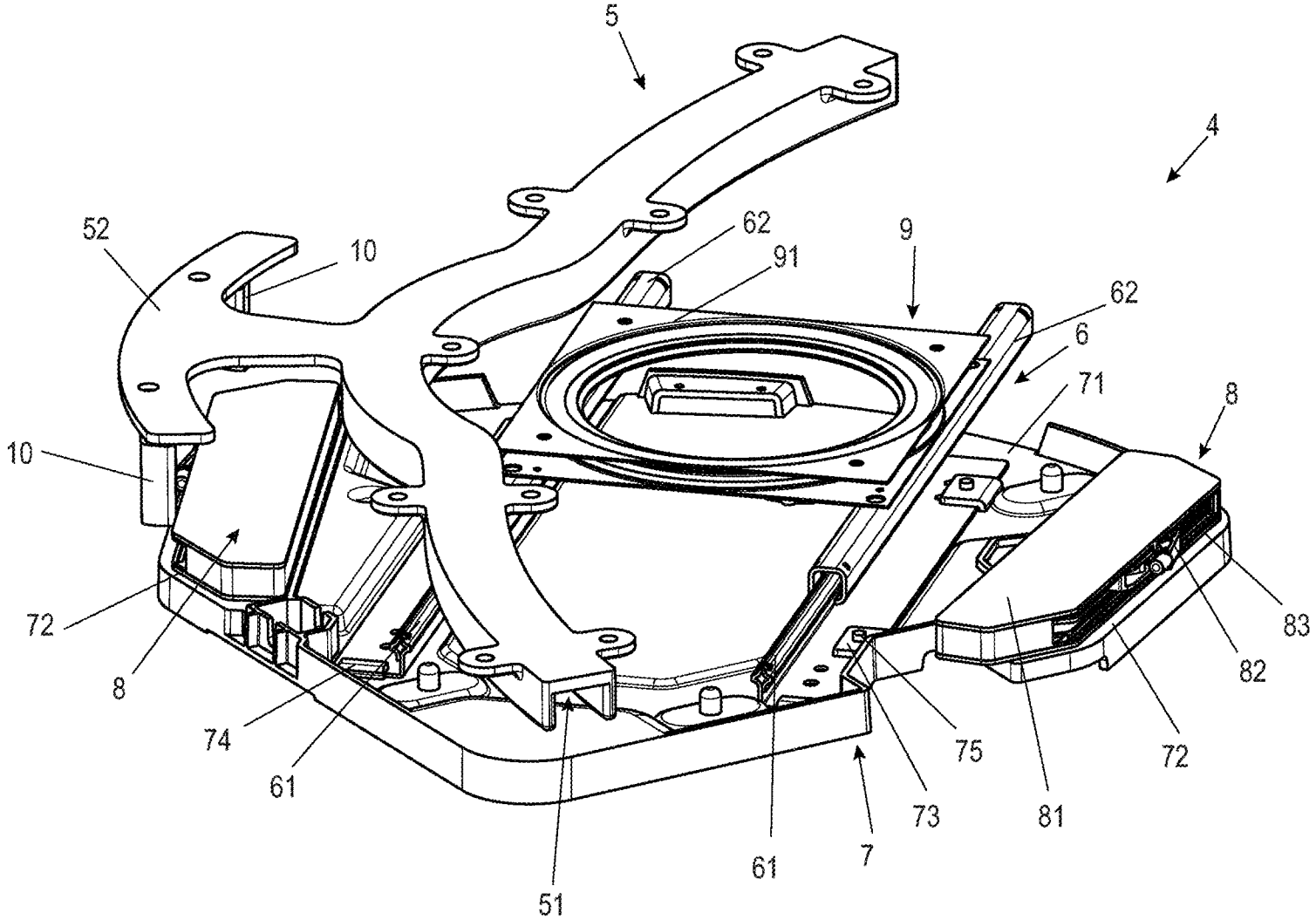
Figure 9:
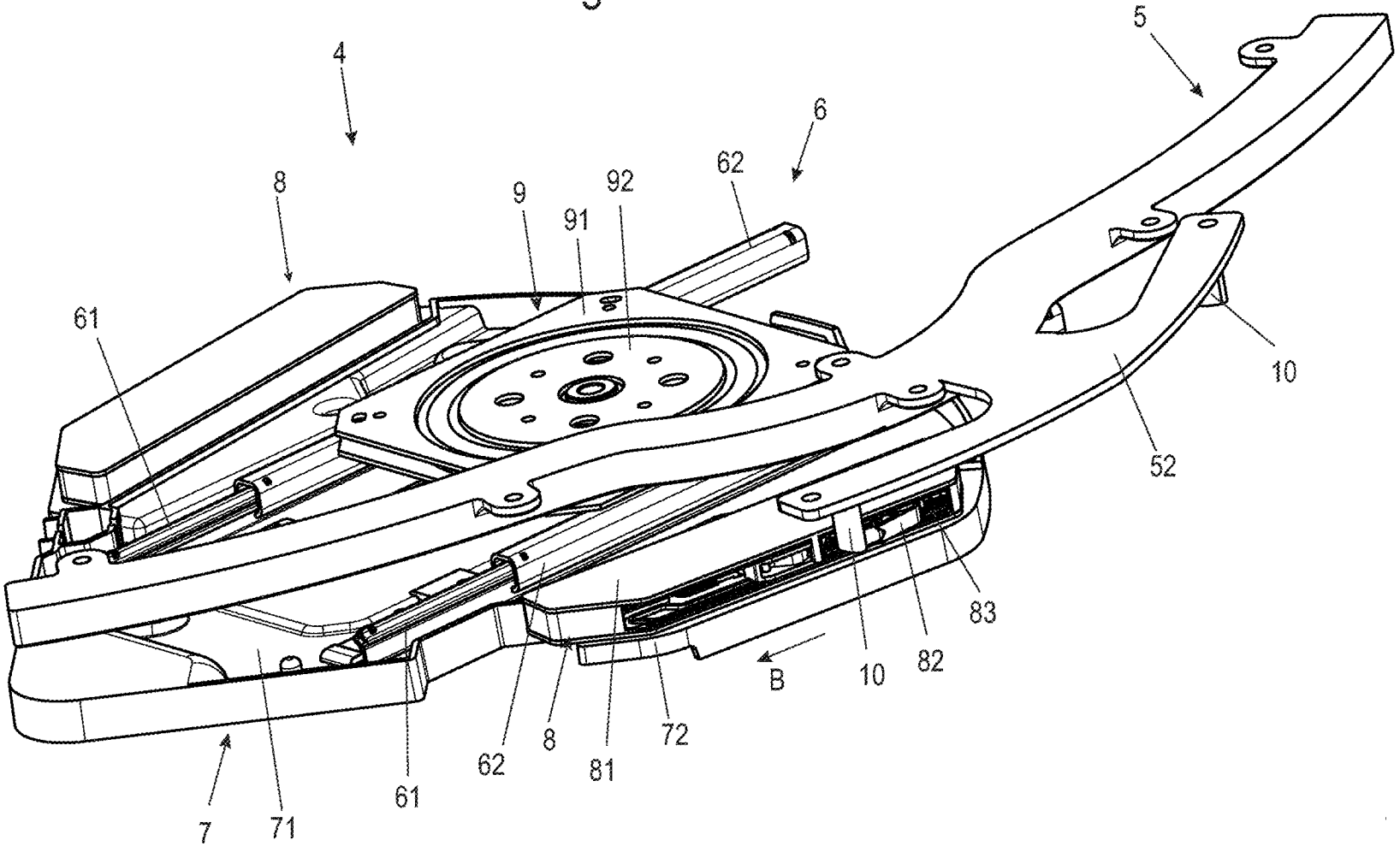
Figure 10:
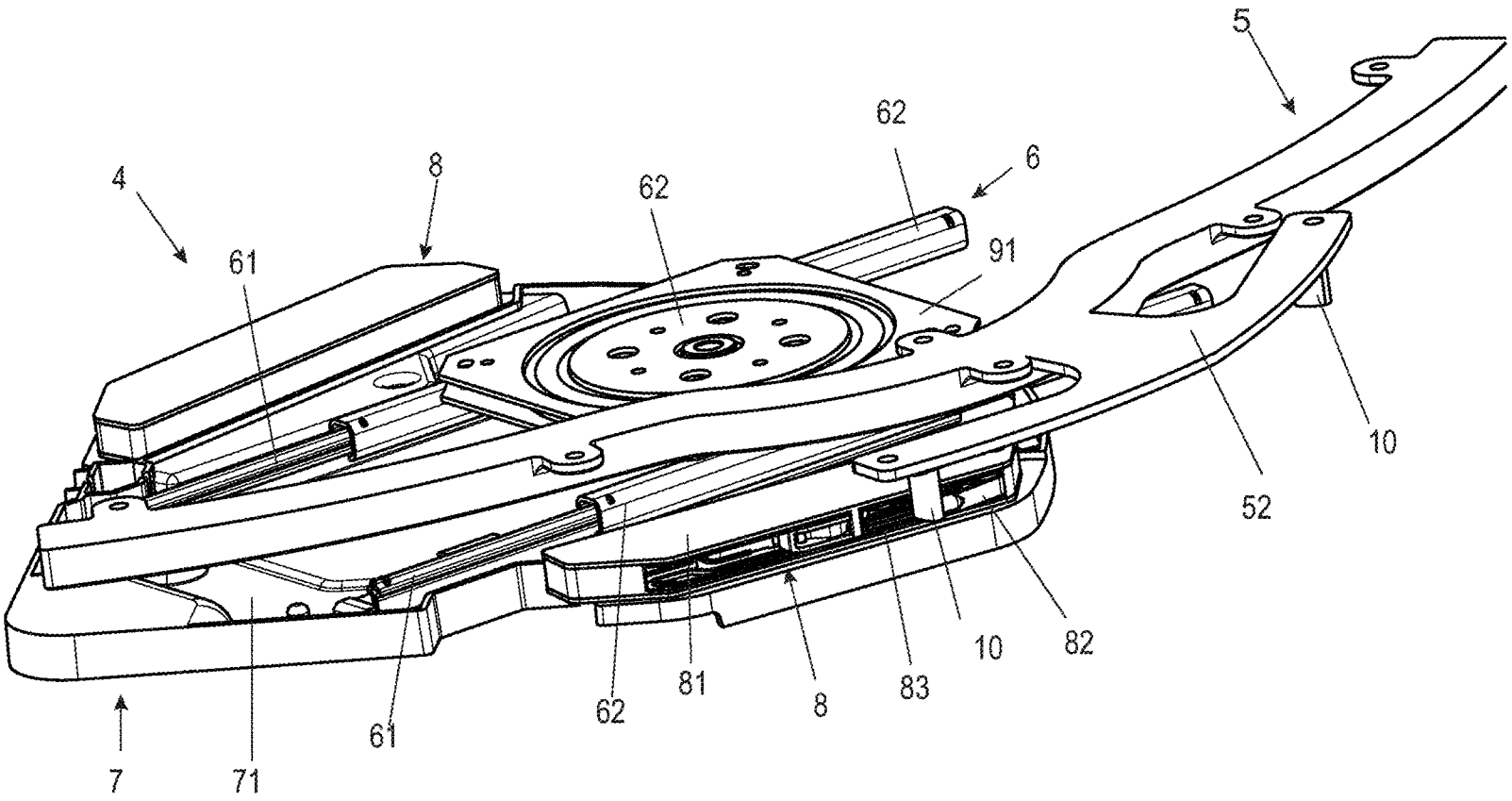
Figure 11:
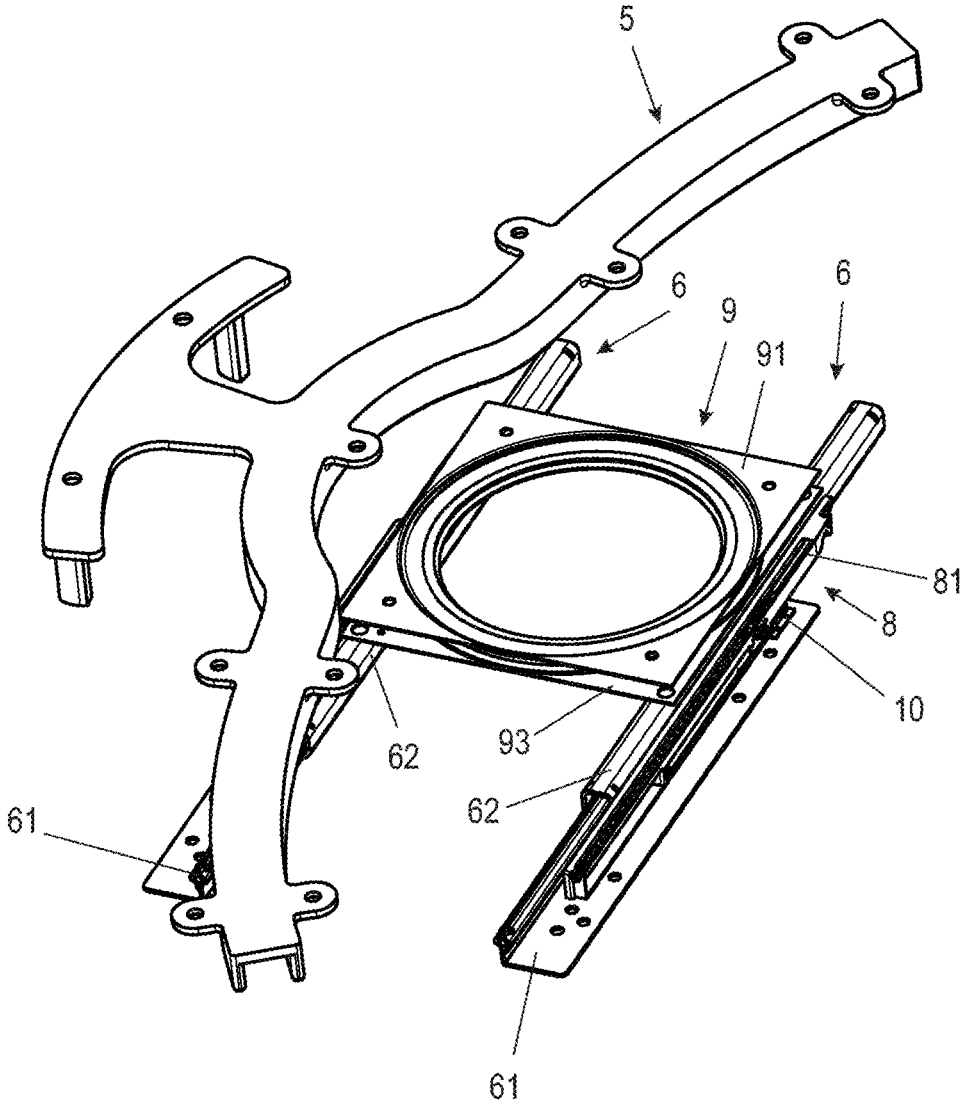
Figure 12:
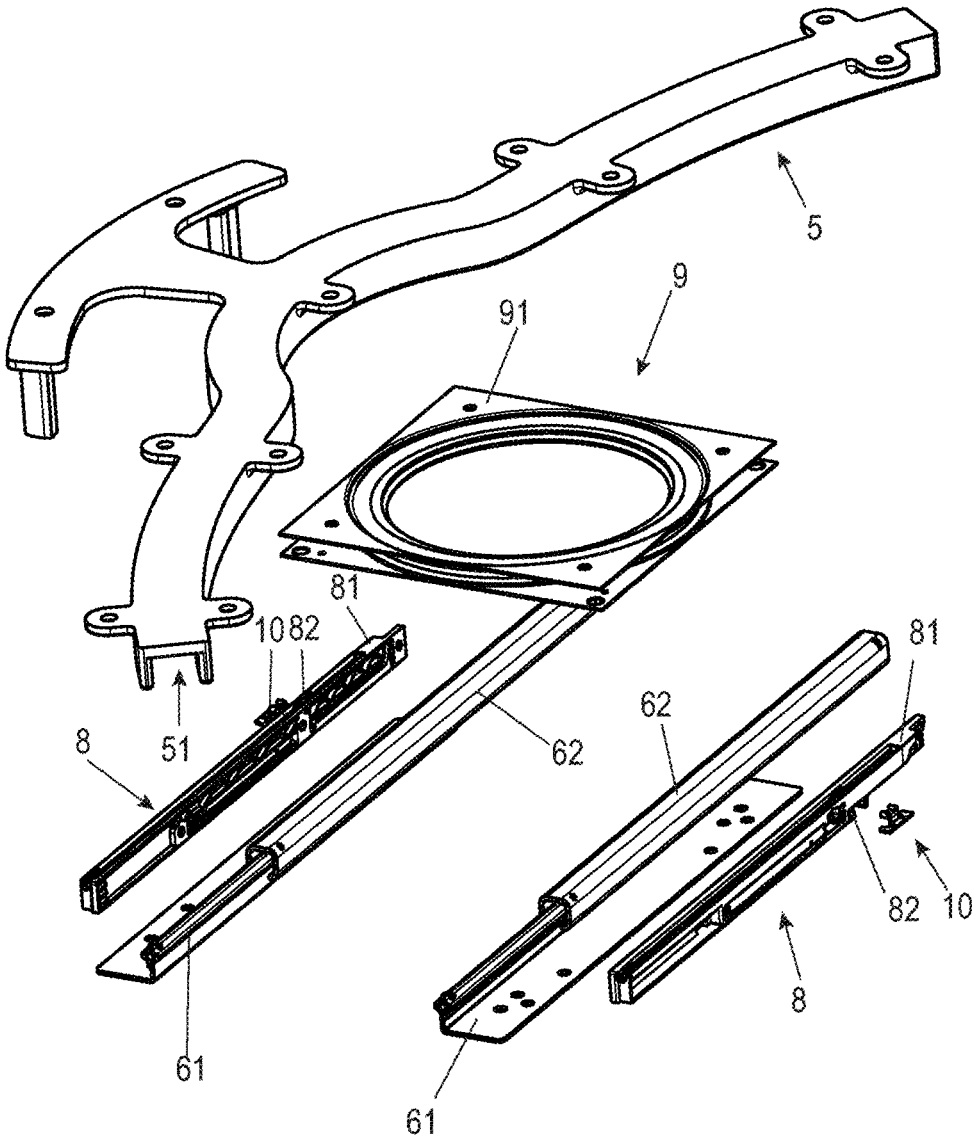
Figure 13:
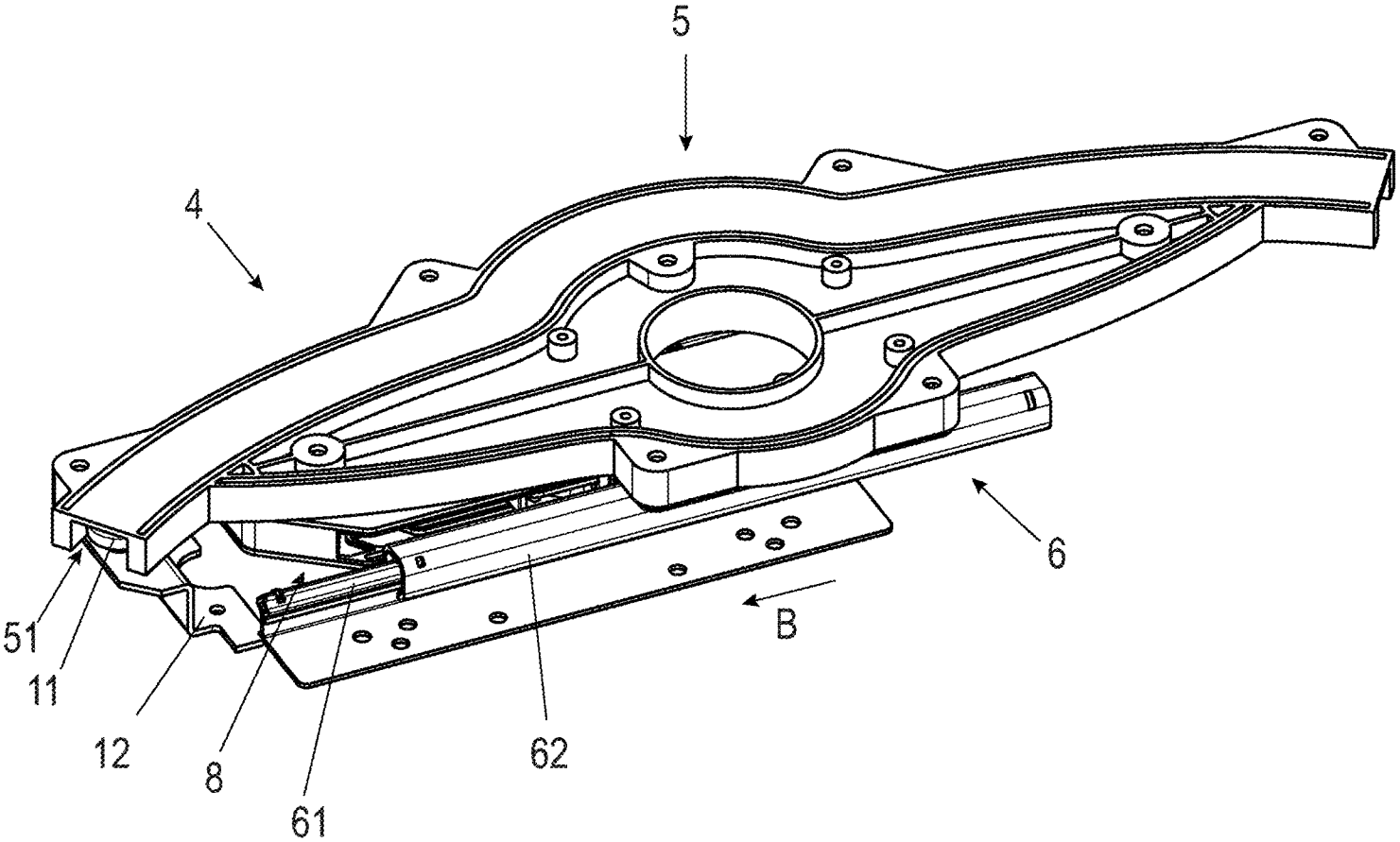
Figure 14:
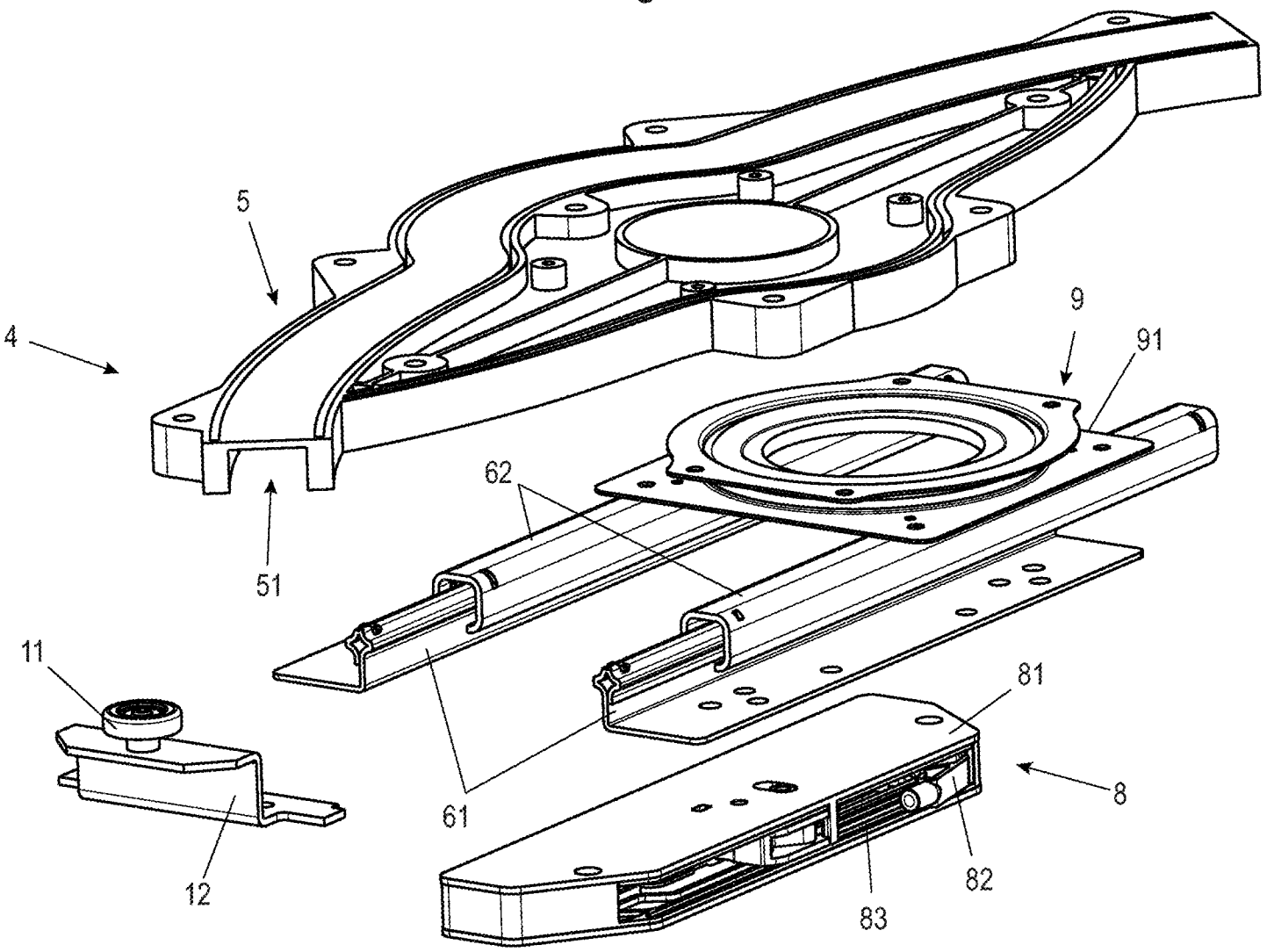
Figure 15:
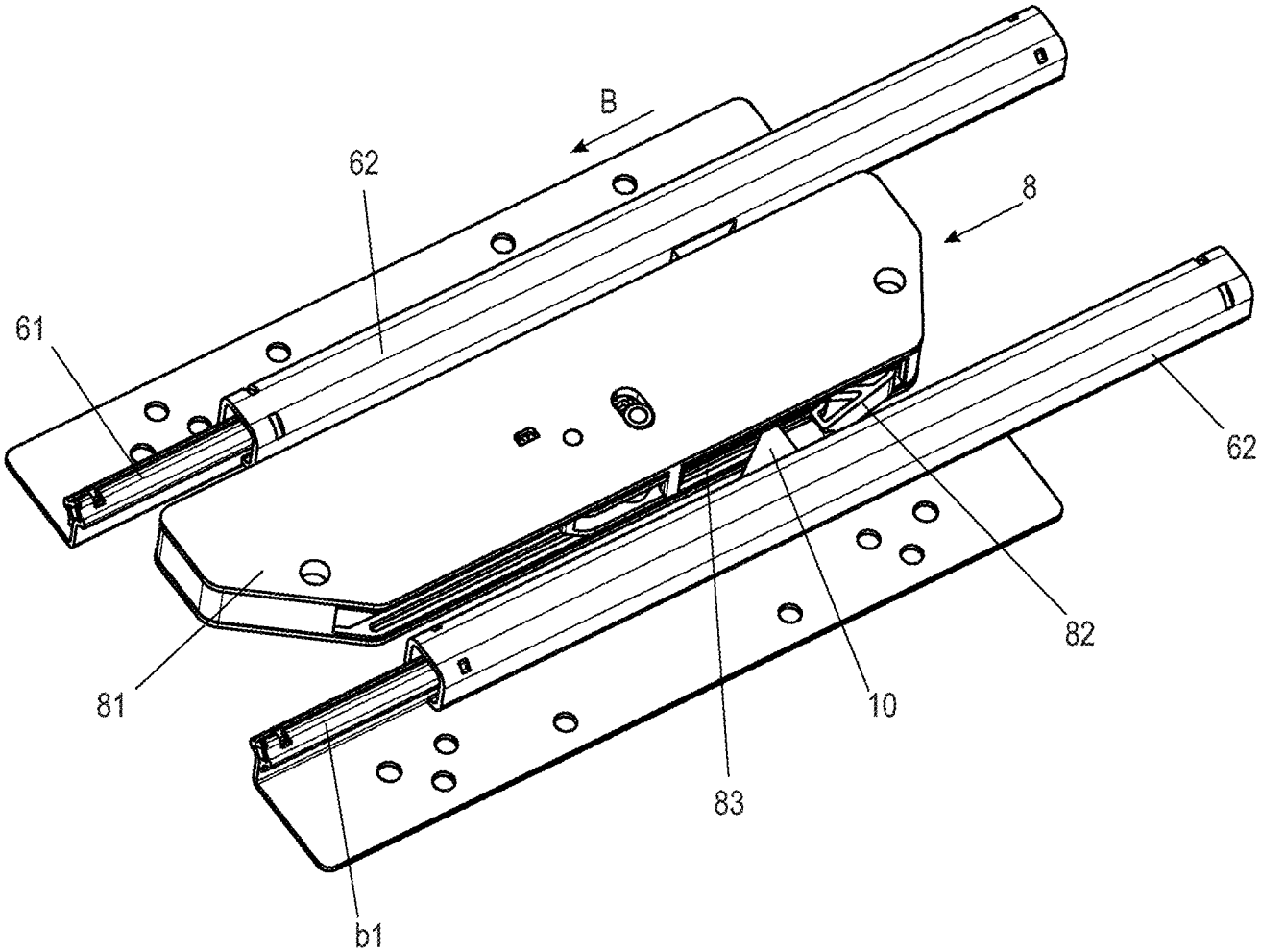
Figure 16:
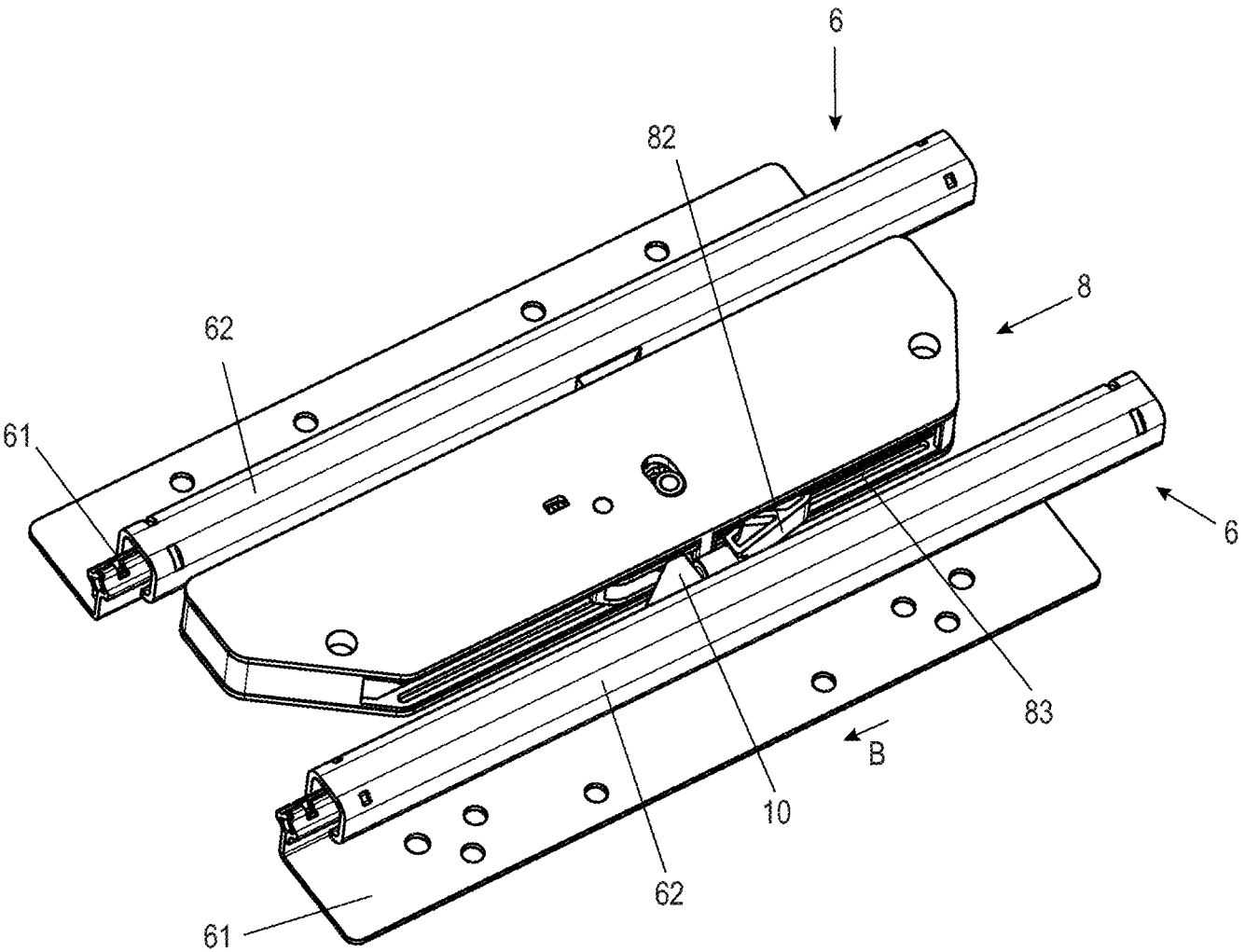
Figure 17:
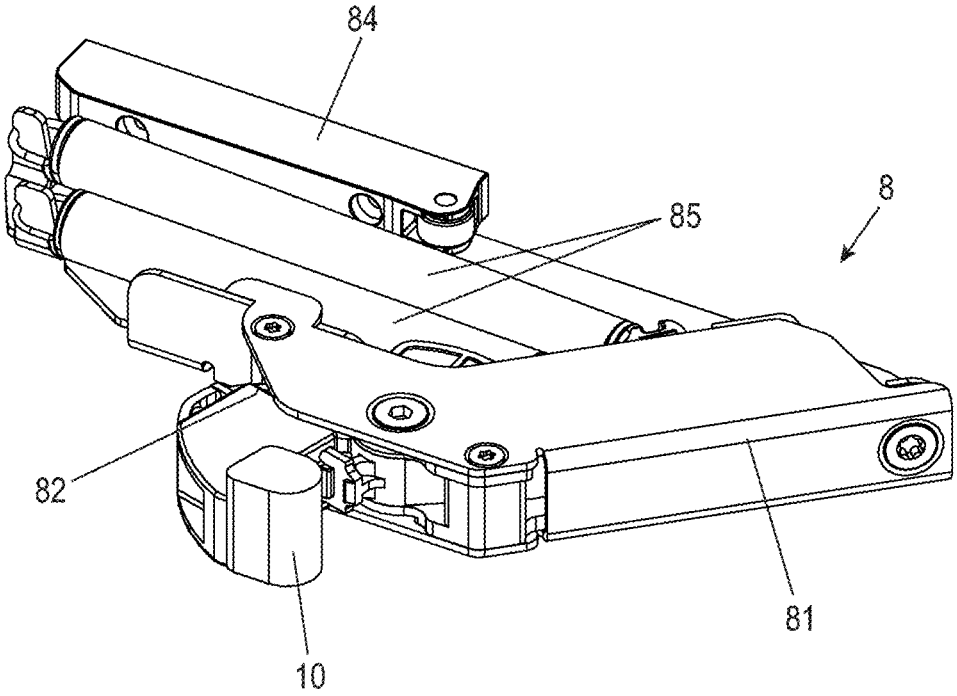

In the following, preferred embodiments of the invention are explained in more detail with reference to the accompanying drawings, wherein:

FIG. 1 shows an embodiment of a furniture element according to the invention with support body and body part, with a body part positioned in an initial position corresponding to a closed position, FIG. 2 shows an isometric view of the furniture element corresponding to FIG. 1 in an intermediate position of the body part relative to the support body caused by the ejection device, FIG. 3 shows an isometric view of the furniture element corresponding to FIG. 1 in an end position of the body part with access to shelves of the body part, FIG. 4 shows an isometric view of the furniture element corresponding to FIG. 2 with the top support plate hidden to show a guide fitting arranged between the top support plate and the top plate, FIG. 5 shows an additional isometric view of the furniture element shown in FIG. 1 in a partially exploded view with a variant of two guide fittings arranged between the base support plate and base plate and the top support plate and top plate, FIG. 6 shows an isometric magnified view of the guide fitting shown in FIG. 5, FIG. 7 shows an exploded view of the guide fitting shown in FIG. 6, FIG. 8 shows an isometric representation of the guide fitting shown in FIG. 6 with the ejection device extended, FIG. 9 shows a further isometric representation of the guide fitting shown in FIG. 8 with a tensioned ejection device, FIG. 10 shows an isometric representation corresponding to FIG. 9 in the unlocked position of the activator on the ejection device, FIG. 11 shows an isometric representation of an alternative design variant of a guide fitting with an ejection device arranged on the linear guide, FIG. 12 shows an isometric exploded view of the guide fitting shown in FIG. 11, FIG. 13 shows an isometric representation of a further embodiment of a guide fitting according to the invention with an ejection device arranged between parallel guide rails of a linear guide and an activator arranged on one of the guide rails, FIG. 14 shows an exploded view of the guide fitting shown in FIG. 13 and FIG. 15 shows a detailed isometric representation of the ejection device and the activator arranged on a running rail in the starting position, FIG. 16 shows a representation corresponding to FIG. 15 with the ejection device triggered, FIG. 17 shows a perspective view of an ejection device in the assembled position;

FIGS. 18A to 18D show multiple views of the ejection of a movable furniture part by the ejection device; and FIGS. 19A to 19D show several views when clamping the ejection device by moving the lever in the closing direction.

DETAILED DESCRIPTION

In the following description of the figures, terms such as top, bottom, left, right, front, rear, etc. refer exclusively to the exemplary representation and position of the guide fitting, the furniture or household appliance element, the ejection device, activator, guide fitting, guide cam track, linear guide and the like selected in the respective figures. These terms are not to be understood restrictively, i.e. these references may change due to different working positions or the mirror-symmetrical design or the like.

In FIGS. 1-5, the reference sign 1 is used to designate an embodiment of a furniture element according to the invention.

The furniture element 1 shown here essentially consists of a support body 2 with a base support plate 21, a top support plate 22, side walls 23 connecting the base support plate 22 to the top support plate 21, as well as a body part 3 that can be moved simultaneously in translation and rotation relative to the support body 2.

Instead of the side wall 23 connecting the base support plate 21 to the top support plate 22, a design variant of the support body 2 without side wall 23 is also conceivable, for example when the base support plate 21 and the top support plate 22 are attached to a building wall.

The body part 3 also has a base plate 31, a top plate 32, and a connecting element connecting the base plate 31 to the top plate 32, in the embodiment example shown in the form of at least one side wall 33.

In the embodiment shown in these figures, the shelf-like body part 3 has a square base area with two side walls 33, which close an interior space in a closed position shown in FIG. 1, and two open vertical sides, shown in FIGS. 2 and 3, which allow access to the interior space.

Instead of the side walls, it is also conceivable to connect the base plate 31 to the top plate 32 via support spars 36, shown as an example in FIG. 3, or a central post in the middle of the surface of the base plate 31 or top plate 32.

In the embodiment shown here, the interior of the body part 3 has several shelves 35. However, other configurations or subdivisions of the interior of the body part 3 are also conceivable in principle.

As further shown in FIGS. 2, 4, and 5, a guide fitting 4 is arranged between the top support plate 22 and the top plate 32, shown in FIGS. 2 and 4, and/or between the base support plate 21 and the base plate 31, shown in FIG. 5, by means of which the simultaneous translational and rotational movement of the body part 3 relative to the support body 2 is made possible.

Preferred embodiments of such a guide fitting 4 are shown in more detail in FIGS. 6-16.

A first embodiment of such a guide fitting 4 is shown in FIGS. 6-10.

As shown in FIGS. 6 and 7, the guide fitting 4 has a guide cam track 5 and a guide element 11 guided in the guide cam track 5. In principle, it is also conceivable to provide several guide cam tracks 5 with a respective guide element 11 on the guide fitting 4.

The guide fitting 4 also has a linear guide 6 with at least two connecting parts that can move relative to each other, one of which is coupled to the guide element 11 in a fixed position and the other is coupled to the guide cam track 5 by means of a pivot bearing 9.

In the embodiment shown in the figures, the linear guide consists of two guide rails 61 aligned parallel to one another and running rails 62 that can be moved relative to these.

Other design variants of linear guides are also conceivable, for example in the form of a guide rail and a roller carriage, rack or similar guided on or along it.

The guide cam track 5 or the guide element 11 can be fixed to the body part 3.

As can also be seen in FIGS. 6 and 7, the guide fitting 4 has at least one, in this embodiment example two, ejection devices 8 with an unlockable force accumulator, with which the body part 3 can be driven from at least one end position by exerting force against an ejection direction B along a limited distance.

The drive is effected by power transmission to at least one activator 10, which is used to unlock the power accumulator of the ejection device 8.

In the first embodiment shown in FIGS. 6-10, the guide cam track 5 is fixed to the top plate 32 of the body part 3 or the base plate 31 of the body part 3, as can also be seen by way of example in FIGS. 4 and 5.

The guide cam track 5 has a guide groove 51 in which the guide element 11, designed here as a wheel, can be guided.

The guide element 11, as well as the two first connecting parts, in this case the guide rails 61 of the linear guides 6 and the ejection devices 8, are fixed to a support plate 7. Alternatively, the guide rails 61, the guide element 11 and/or the ejection devices can be arranged directly on the top support plate 22 and/or base support plate 21.

For its part, the support plate 7 is fixed to the top support plate 22 or the base support plate 21 of the base, or in the case of a furniture element 1, to the support body 2.

Different fixing elements 73, 74, 75 are provided in a central region 71 of the support plate 7 to fix the guide rail on 61 of the linear guides 6 to the support plate 7.

Thus, the fixing elements 75 are designed as pins projecting from the central region 71 of the support plate 7, which are accommodated in holes provided for this purpose in a fastening area of the respective guide rail 61 and thus enable the guide rails 61 to be positively fixed in the plane of the support plate 7.

The other fixing elements 73 and 74, which are designed like plates and overlap the fastening area of the guide rails 61, are provided to prevent lifting.

An ejection device 8 is attached to each of the edge regions 72 of the support plate 7. It is also conceivable to provide an ejection device 8 only on one of the edge regions 72 of the support plate 7.

The ejection devices 8 are known per se from the prior art and have a housing 81, an ejector 82 coupled in the housing 81 along a track 83 with the (not shown) force accumulator, which can be moved with the aid of an activator 10 from a relaxed extended position shown, for example, in FIG. 8 to a tensioned function shown in FIG. 10 by pressing the ejector 82 against the ejection direction B.

This tensioning of the energy accumulator takes place in the movement sequence of the body part 3 relative to the support body 2 when the body part 3 moves into an end position, as shown in FIGS. 1 and 3, in which the body part 3 occupies the same space in both different end positions relative to the support body 2 when viewed in a horizontal plane. Other ejection devices can also be used, in which the tensioning of the force accumulator can additionally or alternatively take place during further extension of the body part 3.

If the body part 3 is to be moved out of this position, the body part 3 can be unlocked by pressing it slightly against the direction of rotation R1, R2 controlled by the guide cam track 5, in the example of FIG. 2 by pressing in direction R2, using the activator 10, as shown in FIG. 10, for example.

After unlocking the energy accumulator, this drives the ejector 82 in the ejection direction B. The ejector 82 presses against the activator 10 and thereby pushes the guide cam track 5 and with it the body part 3 in the ejection direction B out of the end position into the position shown in FIG. 2.

After this ejection process, the user can easily move the body part 3 further into the desired position.

Furthermore, in the embodiment shown in FIGS. 6-10, two activators 10 are arranged on an arm 52 branching off from a central region of the guide cam track 5. It is also conceivable to arrange only one activator 10 on the arm 52, provided that an assisted abutment of the furniture is only required in one direction.

The geometry of the arm 52 is designed in such a way that the activators 10 slide along the respective outer sides of the ejection devices 8 and accordingly come into contact with a respective ejector 82 in a predetermined position before the body part 3 reaches its end position.

The activators 10 can be molded directly onto the arm 52. It is also conceivable, for example, to screw the activators 10 to the arm 52 or directly to the body part 3.

The alignment of the two linear guides 6 attached here to the support plate 7, i.e., the guide rails 61 and the running rails 62 that can be moved linearly on them, determine the direction of translation A of the combined translational-rotational movement of the body part 3 relative to the support body.

The pivot bearing 9 fastened to the two running rails 62 comprises a first and second fastening plate 91, 93, wherein the second fastening plate 93 is fastened to the running rails 62 and the first fastening plate 91 can be fastened correspondingly to the top plate 32 or the base plate 31 of the body part 3. In an exemplary embodiment shown in FIG. 9, a turntable 92 is additionally fastened to the first fastening plate 91. The fastening plates 91, 93 are rotatably mounted relative to one another.

In the alternative embodiment shown in FIGS. 11 and 12, ejection devices 8 are fixed directly to the running rails 62 of the linear guide 6.

The activators 10 are fixed at a suitable position on the guide rail 61.

In this design variant, the force is transmitted from the force accumulator of the ejection devices 8 via the linear guides 6 and not via the guide cam track 5.

A third embodiment of such a guide fitting 4 is shown in FIGS. 13 to 16.

A preferred embodiment of an ejection device 8 that can be used here is shown in FIGS. 17 and 18.

In this embodiment, only one ejection device 8 is provided, the housing of which is fixed to the support plate 7 like the guide rails 61 or alternatively to the base plate 31 or the top plate 32 of the body parts 3. In this case, the activator 10 is arranged on the running rail 62. This embodiment thus represents a quasi-kinematic reversal of the embodiment variant shown in FIGS. 11 and 12.

In FIG. 15, the ejector 82 of the ejection device 8 is shown in the position in which the body part 3 is in an end position.

FIG. 16 shows the ejector 82 of the ejection device 8 with the force accumulator released, in which the running rail 62 has been displaced accordingly over the activator 10, which is accompanied by a movement of the body part 3 into the position shown here as an example in FIG. 2.

Instead of the mechanical ejection devices 8 shown here, it is also conceivable to provide electrically or electromechanically driven ejection devices in which the ejector is electrically preloaded, for example with the aid of an electric motor or an electromagnetic drive.

The ejection device can be triggered, for example, by a motion, force or touch sensor. It is conceivable to use a force sensor, which senses a force exerted by a user on the movable body part 3, or a force/displacement detection by a sensor. A touch sensor system can, for example, use electrically conductive materials to detect a touch that initiates an opening movement. It is also conceivable to control an electric motor or electromagnetic drive via a preferably wireless remote control, for example via a cell phone, voice control, or similar, or via a proximity sensor or an optical sensor that recognizes gestures. The ejection device 8 is returned to a standby position after a predetermined time or after an opening process has been detected.

It is also conceivable to operate only the reset of the ejection device 8 electrically and to carry out the ejection process itself mechanically, for example by using one or more springs (described in more detail below).

It is also conceivable to operate the unlocking of the ejection device 8 electrically and to carry out the ejection process itself mechanically.

A preferred variant of such an ejection device 8 is shown in FIGS. 17, 18A-18D and 19A-19D. Further details of the ejection device described with reference to these figures can be found in the post-published DE 10 2022 134 222 A1, the contents of which are expressly referred to here. The ejection device 8 comprises a housing 81 on which the ejector 82 is rotatably mounted. The ejector 82 acts on the activator 10, which can be coupled to a movable furniture part. The ejector 82 is pretensioned by a force accumulator 85 in a direction of rotation in the opening direction of the movable furniture part, whereby the ejector 82 can be latched by a latching mechanism with tensioned force accumulator 85. A clamping element 84 is also shown on the ejection device 8, which is fixed to the movable furniture part.

The ejector 82 comprises a control section which is arranged inside the housing 81. A slider 88, which has a latch 861 and a control element 871, is slidably held on the control section. The latch 861 is guided in the cam guide 86 on an insert element, while the control element 871 is guided on the control cam 87.

Furthermore, a pressure piece 89 is rotatably mounted on the control section and is held by a fastening plate 891, which is fixed to the control section. The pressure piece 89 is guided by a driver on a further control cam, which is fixed to the insert element.

Figure 18A:
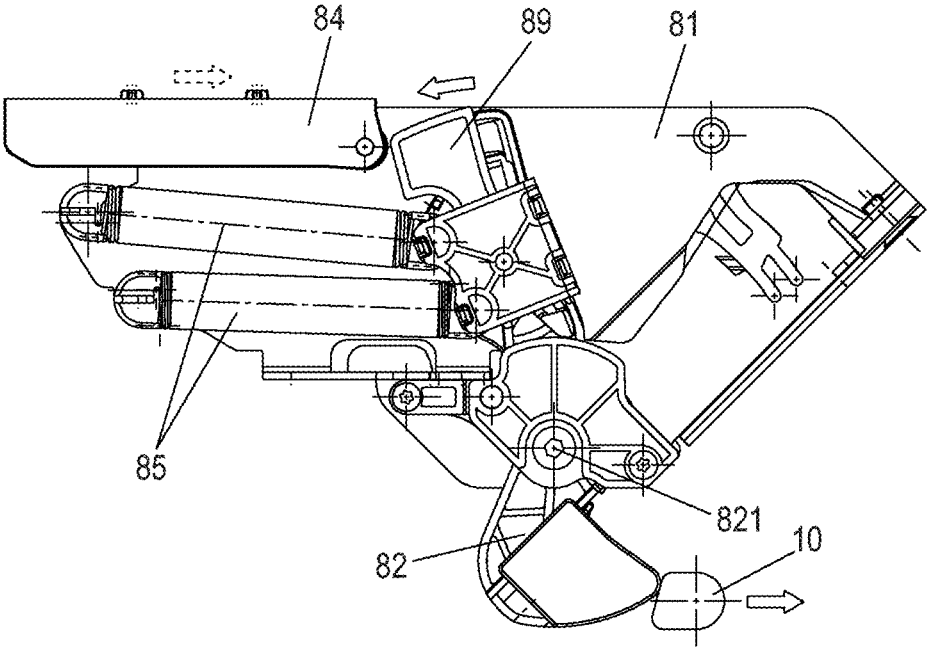
Figure 18B:
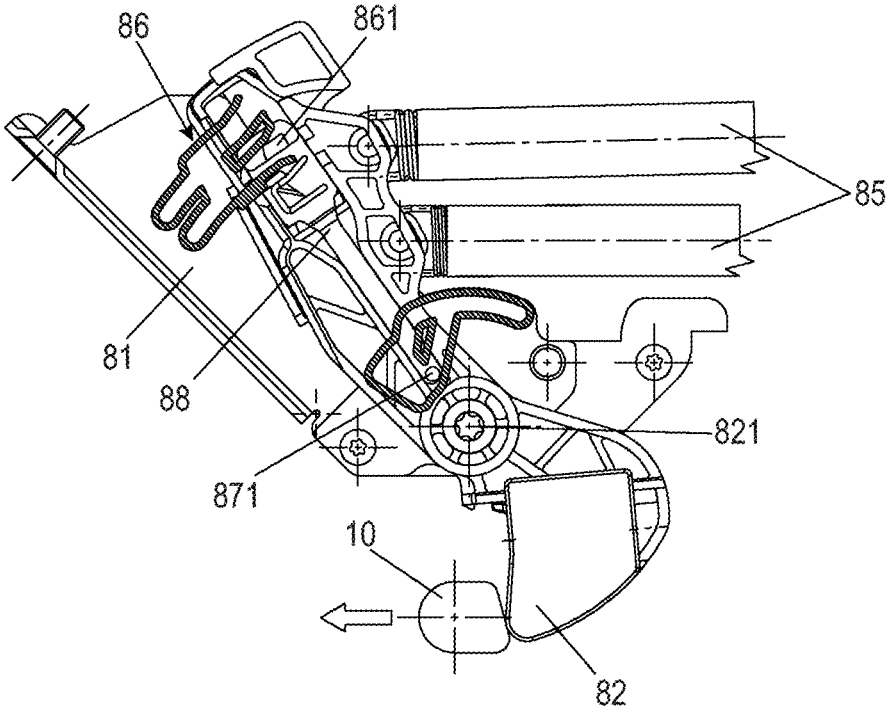

FIGS. 18A and 18B show the ejection device 8 ejecting a movable piece of furniture not shown. The ejector 82 is rotated counterclockwise in FIG. 18A and clockwise in FIG. 18B by the force of the force accumulators 85 and thus acts on the activator 10, which moves the movable furniture part from the starting position in the opening direction.

The ejector 82 pivots so far that the latch 861 moves out of the cam guide 86, which is open and has an extension channel and a retraction channel. In FIG. 18B, the latch 861 is still in the extension channel of the cam guide 86, and in FIGS. 18C and 18D, the latch 861 has moved away from the cam guide 86 at the slider 88. The movable furniture part moves with the activator 10 from right to left in FIGS. 18B to 18D, and the clamping element 84 attached to the movable furniture part reaches the pressure piece 89 attached to the ejector 82 in the ejected opening position.

Figure 18C:
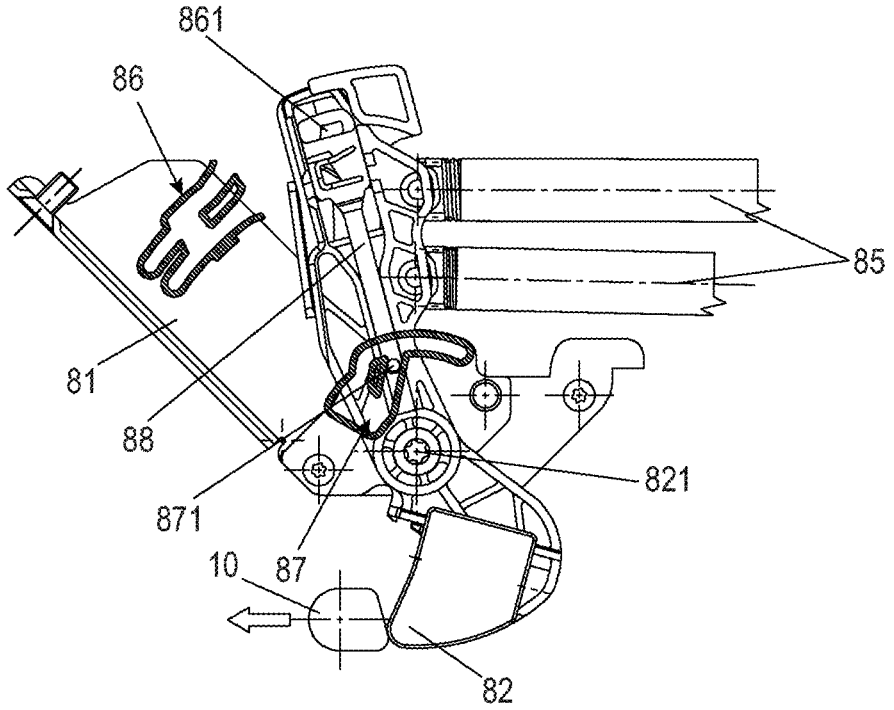

As a result of the rotary movement of the ejector 82, the control element 871 moves along the control cam 87 and displaces the slider 88 in a radial outward direction, as can be seen from FIGS. 18B and 18C, until the control element 871 is arranged in a channel which extends substantially in the circumferential direction around the axis of rotation 821. From this opening position, the movable furniture part can now be moved either in the closing direction or in the opening direction, whereby in both cases the ejector 82 is pivoted back into the starting position and the latching mechanism is brought into the starting position.

FIGS. 19A to 19D show the clamping process of the ejector 82 when the movable furniture part with the activator 10 is moved back in the closing direction. The activator 10 then presses against the ejector 82 and pivots it clockwise in FIG. 19A and counterclockwise in FIGS. 19B to 19D.

The ejector 82 is rotated by the activator 10, and the control element 871 moves along the control cam 87 and displaces the slider 88 in a radial direction towards the axis of rotation 821. The latch 861 is positioned via the control cam 87 so that it enters the entry channel of the cam guide 86 and takes over the guidance of the slider 88 there.

Figure 19A:
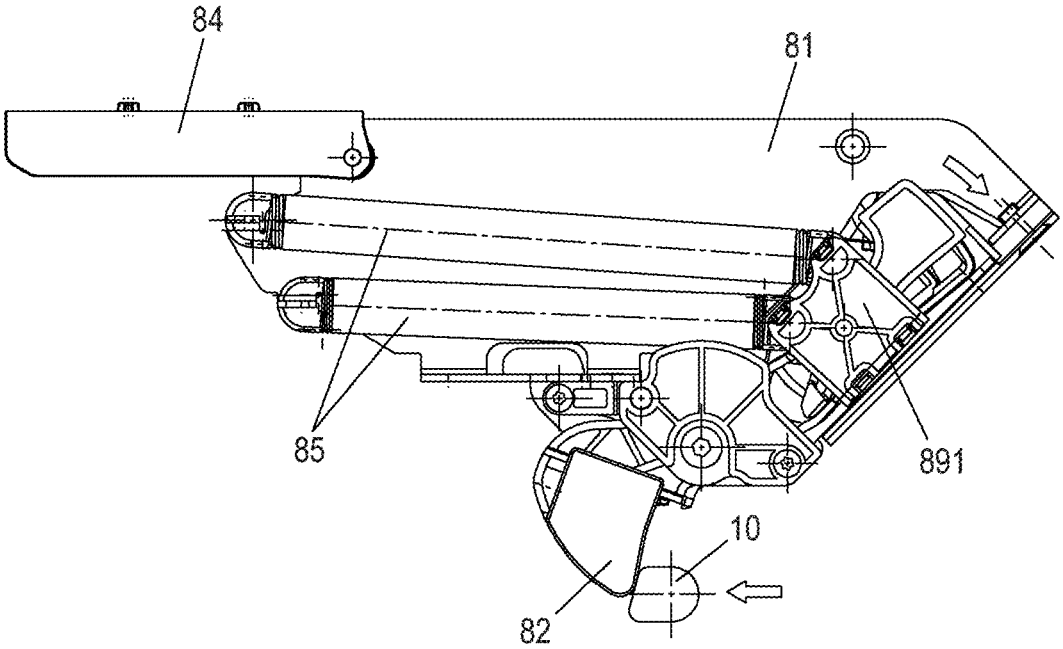
Figure 19B:
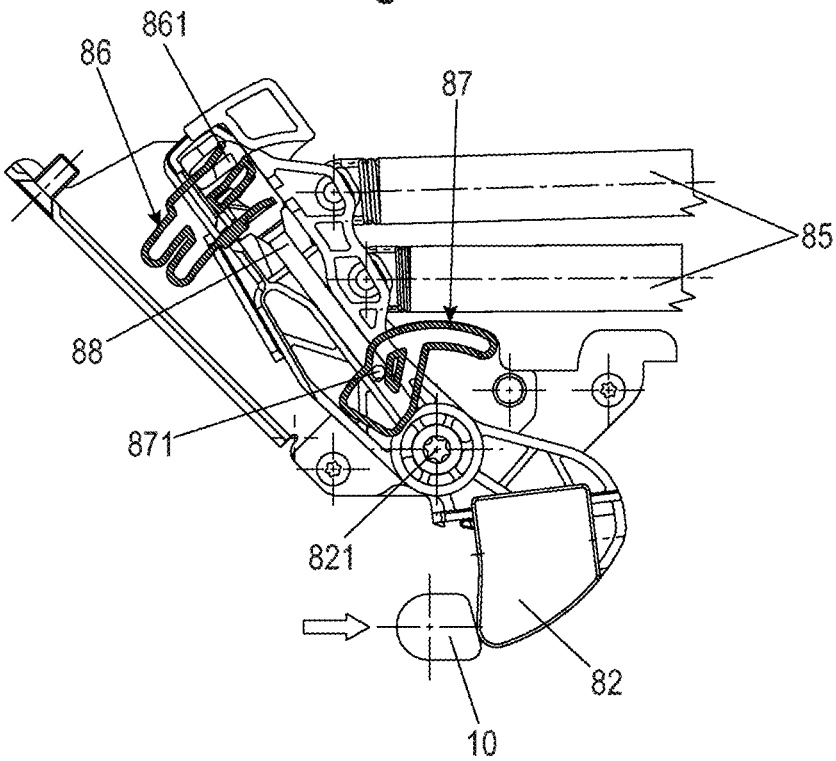
Figure 19C:
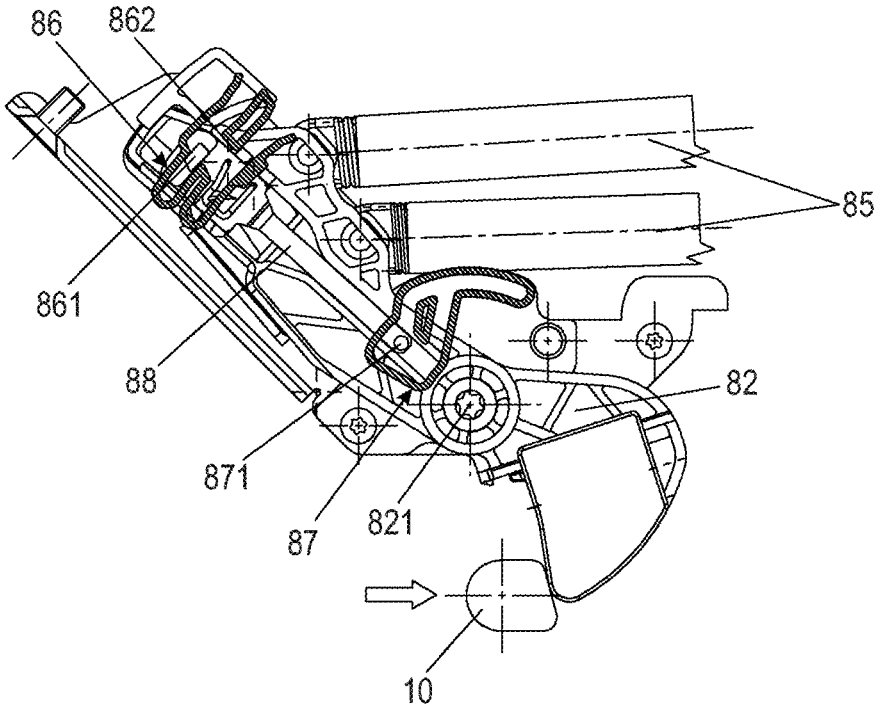

In FIG. 19C, the movable furniture part with the activator 10 is shown in an overpressure position, and the ejector 82 has been pivoted to such an extent that the latch 861 has been moved along the cam guide 86 via the latching receptacle 862. The guidance of the slider 88 is now determined by the latch 861, and the control element 871 has no function.

Figure 19D:
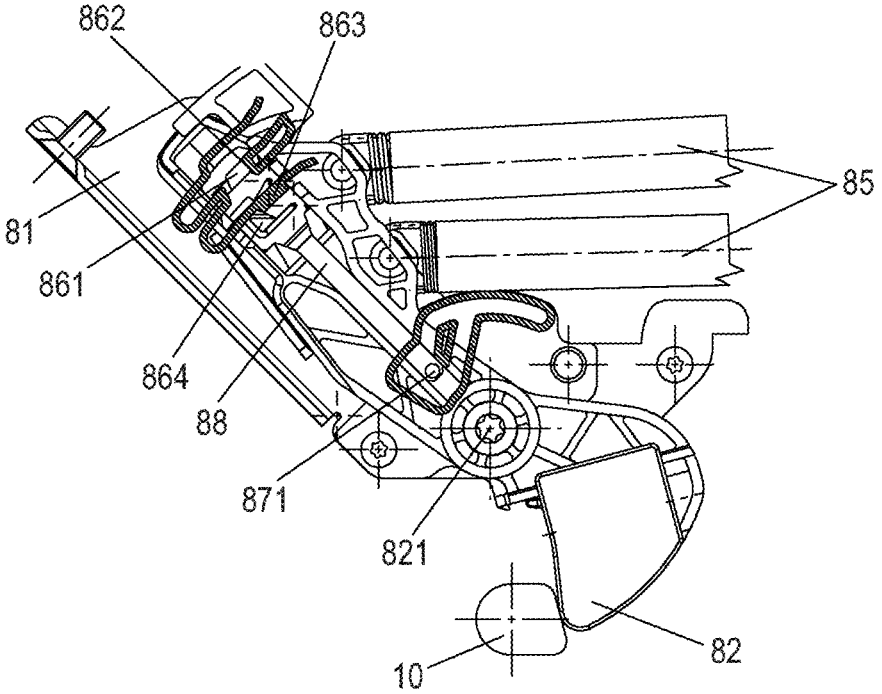

When the movable furniture part is released, the activator 10 is moved in the opposite direction by the force of the force accumulator 85, whereby a latching projection 864 pushes the latch 861 into the latching receptacle 862 via a stop 863, where the latch 861 latches. FIG. 19D thus corresponds to the starting position and the closed position of the movable furniture part, which can be unlocked again by pressing it into an overpressure position, as described above.

Figure 18D:
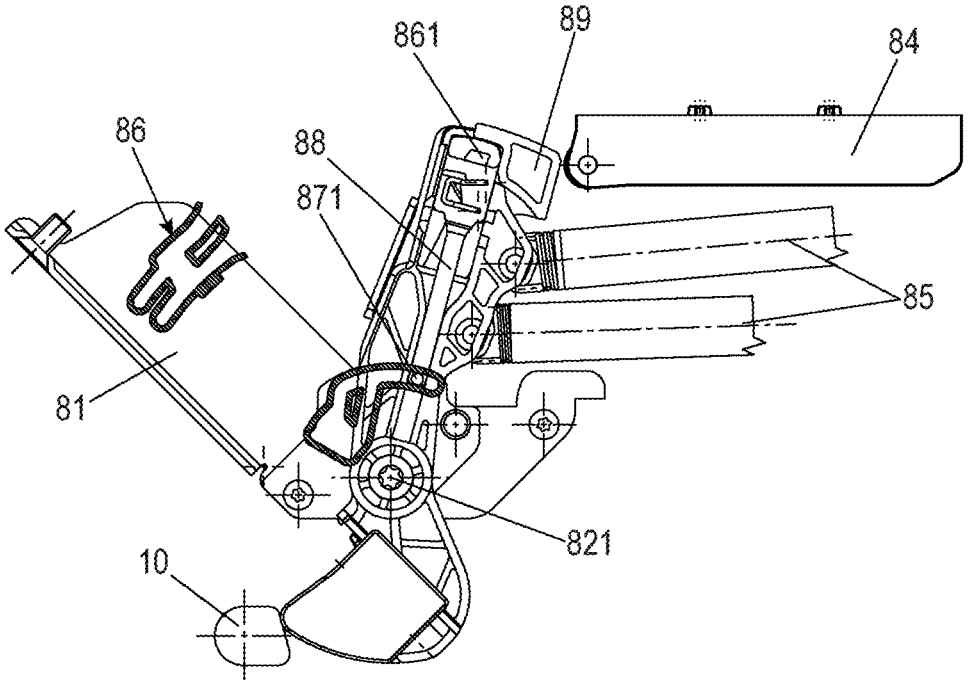

The ejection device 8 can also be tensioned from the position shown in FIG. 18D by moving the movable furniture part in the opening direction by the clamping element 84 instead of by moving the movable furniture part in the closing direction.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE SIGNS

1 Furniture or household appliance element
2 Support body
21 Base support plate
22 Top support plate
23 Side wall
3 Body part
31 Base plate
32 Top plate
33 Page wall
35 Shelf
36 Support spar
4 Guide fitting
5 Guide cam track
51 Guide groove
52 Arm
6 Linear guide
61 Guide rail
62 Rail
7 Support plate
71 Central region
72 Edge region
73 Fixing element
74 Fixing element
75 Fixing element
8 Ejection device
81 Housing
82 Ejector
821 Axis of rotation
83 Track
84 Clamping element
85 Force accumulator
86 Cam guide
861 Latch
862 Latching receptacle
863 Stop
864 Latching projection
87 Control cam
871 Control element
88 Slider
89 Pressure piece
891 Fastening plate
9 Pivot bearing
91 Fastening plate
92 Turntable
10 Activator
11 Guide element
A Direction of translation
B Ejection direction
R1, R2 Direction of rotation

The invention claimed is:

1. A guide fitting configured to guide movement of a body part mounted for simultaneous translational and rotational movement relative to a stationary base, the guide fitting comprising:

a guide cam track;

a guide element guided in the guide cam track;

a linear guide with a first connecting part and a second connecting part, wherein the second connecting part is movable relative to the first connecting part, wherein one of the first and second connecting parts is coupled in a stationary manner to the guide element and the other one of the first and second connecting parts is coupled to the guide cam track by a pivot bearing, wherein the guide cam track or the guide element is configured to be fixedly attached to the body part;

at least one ejection device with an unlockable force accumulator, wherein the at least one ejection device is configured to drive the body part from at least one end position by exerting force counter to an ejection direction along a limited distance; and at least one activator configured to unlock the unlockable force accumulator of the ejection device, wherein the linear guide consists of two guide rails aligned parallel to one another and running rails, roller carriages, or racks displaceable relative to the two guide rails.

2. The guide fitting of claim 1, wherein the at least one ejection device is arranged in a fixed position relative to the guide element.

3. The guide fitting of claim 1, wherein the at least one activator includes two activators arranged on or fixedly spaced from the guide cam track.

4. The guide fitting of claim 1, wherein the guide cam track has a guide groove accommodating the guide element and an arm extending outside the guide groove, wherein the at least one activator is arranged on the arm extending outside the guide groove.

5. The guide fitting of claim 4, wherein the at least one activator includes two activators are arranged on the arm extending outside the guide groove.

6. The guide fitting of claim 1, further comprising:

a support plate, wherein one of the at least one of the first and second connecting parts of the linear guide, the guide element, and the at least one ejection device are fixed on the support plate.

7. The guide fitting of claim 6, wherein the first connecting part comprises two first connecting parts aligned parallel to one another, wherein the support plate has a central region, to which the two first connecting parts of the linear guide are fastened, and two edge regions of mirror-symmetrical shape, wherein the at least one ejection device is to at least one of the two edge regions.

8. The guide fitting of claim 1, wherein the at least one activator is arranged in a stationary manner on the second connection part of the linear guide, and the at least one ejection device is arranged in a stationary manner on or near the first connection part of the linear guide.

9. The guide fitting of claim 8, wherein the second connecting part comprises two second connecting parts arranged next to each other and parallel to each other, and wherein the at least one ejection device is arranged between the two second connecting parts of the linear guide.

10. The guide fitting of claim 1, wherein the at least one ejection device is an at least partially electrical ejection device.

11. The guide fitting of claim 1, further comprising:

at least one further guide cam track in which a further guide element is guided.

12. A furniture or household appliance element comprising:

a support body with a base support plate, a top support plate, and at least one side wall;

a body part mounted for simultaneous translational and rotational movement relative to the support body, wherein the body part comprises a base plate, a top plate, and at least one side wall;

a guide fitting arranged between the top support plate and the top plate or arranged between the base support plate and the base plate, wherein the guide fitting comprises a guide cam track;

a guide element guided in the guide cam track, wherein the guide cam track and the guide element are arranged on respective mutually facing surfaces of the top support plate and the top plate or are arranged on the respective mutually facing surfaces of the base support plate and the base plate;

a linear guide with a first connecting part and a second connecting part displaceable relative to one another in a direction of translation, wherein one of the first and second connecting parts is arranged on the top support plate or the top plate and the other one of the first and second connecting parts is mounted on the other of the top support plate or the top plate by a pivot bearing, or the one of the first and second connecting parts is arranged on the base support plate or the base plate and the another one of the first and second connecting parts is mounted on the other of the base support plate or the base plate by a pivot bearing at least one ejection device with an unlockable force accumulator, wherein the at least one ejection device is configured to drive the body part from at least one end position by exerting force counter to an ejection direction along a limited distance; and at least one activator configured to unlock the unlockable force accumulator of the ejection device, wherein the linear guide consists of two guide rails aligned parallel to one another and running rails, roller carriages, or racks displaceable relative to the two guide rails.

13. The furniture or household appliance element of claim 12, wherein the guide cam track is fixed to the base plate or the top plate of the body part and the guide element is fixed to the base support plate or the top support plate of the support body.

14. The furniture or household appliance element of claim 12, wherein the guide fitting comprises a first and a second guide fitting, wherein the first guide fitting is arranged between the base support plate and the base plate and the second guide fitting is arranged between the top support plate and the top plate.

15. The furniture or household appliance element of claim 12, wherein the body part is movable relative to the support body from a first functional position into a second functional position rotated by a predetermined angle relative to the first functional position, and wherein the base plates and the top plates of the body part and of the support body are in matching geometries relative to one another in both the first and second functional positions.

* * * * *